US011491391B2

(12) United States Patent
Shigeta

(10) Patent No.: US 11,491,391 B2
(45) Date of Patent: Nov. 8, 2022

(54) SYSTEM AND METHOD FOR DELIVERING PLAYING CARDS

(71) Applicant: ANGEL GROUP CO., LTD., Shiga (JP)

(72) Inventor: Yasushi Shigeta, Kyoto (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 16/213,022

(22) Filed: Dec. 7, 2018

(65) Prior Publication Data

US 2019/0111331 A1 Apr. 18, 2019

Related U.S. Application Data

(63) Continuation of application No. 14/735,025, filed on Jun. 9, 2015, now Pat. No. 10,238,955, which is a (Continued)

(30) Foreign Application Priority Data

Mar. 19, 2004 (JP) ..... 2004-079519

(51) Int. Cl.
*A63F 1/14* (2006.01)
*A63F 1/18* (2006.01)
(Continued)

(52) U.S. Cl.
CPC ..... *A63F 1/14* (2013.01); *A63F 1/067* (2013.01); *A63F 1/18* (2013.01);
(Continued)

(58) Field of Classification Search
None
See application file for complete search history.

(56) References Cited

U.S. PATENT DOCUMENTS 4,513,696 A 4/1985 Fujii et al.
4,513,969 A 4/1985 Samsel, Jr.
(Continued)

FOREIGN PATENT DOCUMENTS

AU 2013203307 4/2014
CN 101437586 A 5/2009
(Continued)

OTHER PUBLICATIONS

European Extended Search Report, European Patent Application No. 13842336.3, dated Aug. 24, 2016.
(Continued)

*Primary Examiner* — Tramar Harper
(74) *Attorney, Agent, or Firm* — Norton Rose Fulbright US LLP

(57) ABSTRACT

A method includes. determining numbers of a cards sequentially removed from a card shooter and delivered to one or more persons during a round of a card game. The method further includes determining, based on the determined numbers of the cards and based on one or more signals received from a set of card detecting optical sensors of a group of sensors located on one or more card guide rails, whether there is an attempt to draw a card from the card shooter after the round of the card game is over. The method also includes, based a determination of that the attempt occurred, generating a signal indicating the attempt.

17 Claims, 21 Drawing Sheets

Related U.S. Application Data continuation of application No. 13/914,404, filed on Jun. 10, 2013, now Pat. No. 9,656,155, which is a continuation-in-part of application No. PCT/JP2012/006230, filed on Sep. 28, 2012, and a continuation-in-part of application No. 11/884,021, filed as application No. PCT/JP2005/003789 on Mar. 4, 2005, now Pat. No. 8,561,989.

(51) Int. Cl.
*A63F 1/06* (2006.01)
*A63F 9/24* (2006.01)
*A63F 1/00* (2006.01)

(52) U.S. Cl.
CPC . *A63F 2001/001* (2013.01); *A63F 2009/2444* (2013.01); *A63F 2009/2447* (2013.01); *A63F 2250/58* (2013.01)

(56) References Cited

U.S. PATENT DOCUMENTS 4,534,562 A 8/1985 Cuff et al.
4,586,712 A 5/1986 Lorber et al.
4,794,239 A 12/1988 Allais
5,067,713 A 11/1991 Soules et al.
5,166,502 A 11/1992 Rendleman et al.
5,169,155 A 12/1992 Soules et al.
5,259,907 A 11/1993 Soules et al.
5,331,141 A 7/1994 Kaneko
5,374,061 A 12/1994 Albrecht
5,669,813 A 9/1997 Jairazbhoy et al.
5,669,816 A 9/1997 Garczynski et al.
5,707,287 A 1/1998 McCrea, Jr.
5,722,893 A 3/1998 Hill et al.
5,779,546 A 7/1998 Meissner et al.
5,814,804 A 9/1998 Kostizak
5,911,626 A 6/1999 McCrea, Jr.
5,941,769 A 8/1999 Order
6,039,650 A 3/2000 Hill
6,042,150 A 3/2000 Daley
6,066,857 A 5/2000 Fantone et al.
6,093,103 A 7/2000 McCrea, Jr.
6,098,892 A 8/2000 Peoples, Jr.
6,126,166 A 10/2000 Lorson et al.
6,217,447 B1 4/2001 Lofink et al.
6,270,406 B1 8/2001 Sultan
6,460,848 B1 10/2002 Soltys et al.
6,527,191 B1 3/2003 Jannersten
6,543,770 B1 4/2003 Kaji et al.
6,582,301 B2 6/2003 Hill
6,588,751 B1 7/2003 Grauzer et al.
6,629,894 B1 10/2003 Purton
6,637,622 B1 * 10/2003 Robinson ..... A63F 1/14 221/232
6,638,161 B2 10/2003 Soltys et al.
7,029,009 B2 4/2006 Grauzer et al.
7,093,130 B1 8/2006 Kobayashi et al.
7,172,507 B2 2/2007 Fujimoto et al.
7,222,852 B2 5/2007 Soltys et al.
7,422,522 B2 9/2008 Fujimoto et al.
7,762,889 B2 7/2010 Shigeta
7,946,586 B2 5/2011 Krenn et al.
7,967,672 B2 6/2011 Shigeta
8,221,244 B2 7/2012 French
8,309,163 B2 11/2012 Van Duren et al.
8,556,262 B2 10/2013 Shigeta
8,590,896 B2 11/2013 Krenn et al.
8,801,516 B2 8/2014 Shigeta
RE46,505 E 8/2017 Hill
2002/0017481 A1 2/2002 Johnson et al.
2002/0063389 A1 5/2002 Breeding et al.
2002/0068635 A1 6/2002 Hill
2002/0155869 A1 10/2002 Soltys et al.
2002/0163125 A1 11/2002 Grauzer et al.
2002/0165029 A1 11/2002 Soltys et al.
2003/0003997 A1 1/2003 Vuong
2003/0171142 A1 9/2003 Kaji et al.
2003/0176209 A1 9/2003 Soltys et al.
2003/0195025 A1 10/2003 Hill
2004/0026636 A1 2/2004 Shigeta
2004/0100026 A1 5/2004 Haggard
2005/0012269 A1 1/2005 Grauzer et al.
2005/0049024 A1 * 3/2005 Unsicker ..... A63F 9/183 463/9
2005/0051955 A1 3/2005 Schubert et al.
2005/0062226 A1 3/2005 Schubert et al.
2005/0062227 A1 3/2005 Grauzer et al.
2005/0104290 A1 5/2005 Grauzer et al.
2005/0110210 A1 5/2005 Soltys et al.
2005/0121852 A1 6/2005 Soltys et al.
2005/0137005 A1 6/2005 Soltys et al.
2005/0288086 A1 * 12/2005 Schubert ..... G07F 17/3223 463/11
2006/0247036 A1 11/2006 Shigeta
2007/0018389 A1 1/2007 Downs, III
2007/0138743 A1 * 6/2007 Fleckenstein ..... A63F 1/14 273/149 R
2007/0216092 A1 9/2007 Fleckenstein
2008/0006997 A1 * 1/2008 Scheper ..... A63F 1/14 273/149 R
2008/0105750 A1 5/2008 Shigeta
2008/0224394 A1 9/2008 Shigeta
2009/0017888 A1 * 1/2009 Kuhn ..... G07F 17/3211 463/13
2009/0066021 A1 3/2009 Shigeta
2009/0134575 A1 5/2009 Dickenson et al.
2009/0140492 A1 6/2009 Yoseloff et al.
2009/0243213 A1 10/2009 Pececnik et al.
2010/0013152 A1 * 1/2010 Grauzer ..... A63F 1/14 273/149 R
2010/0276887 A1 11/2010 Yoshida
2010/0327525 A1 12/2010 Shigeta
2011/0130185 A1 6/2011 Walker
2011/0148038 A1 6/2011 Laughlin
2011/0210175 A1 9/2011 Shigeta
2012/0091656 A1 * 4/2012 Blaha ..... A63F 1/12 273/149 R
2012/0306152 A1 12/2012 Krishnamurty et al.
2013/0207344 A1 8/2013 Shigeta
2013/0228971 A1 * 9/2013 Flynn ..... A63F 1/14 273/149 R
2014/0042697 A1 2/2014 Berube et al.
2015/0014925 A1 1/2015 Miller et al.
2015/0375095 A1 12/2015 Shigeta

FOREIGN PATENT DOCUMENTS

CN 101588847 A 11/2009
CN 101711177 A 5/2010
CN 101972544 A 2/2011
CN 202398088 U 8/2012
GB 2380143 A 4/2003
JP H5-398 U 1/1993
JP H5-20512 A 1/1993
JP H9-215812 A 3/1997
JP H9-144353 A 6/1997
JP H10508236 A 8/1998
JP 2000327255 A 11/2000
JP 2001222687 A 8/2001
JP 2002165916 A 6/2002
JP 2002224443 A 8/2002
JP 2002282413 A 10/2002
JP 2003052902 A 2/2003
JP 2003070956 A 3/2003
JP 2003144742 A 5/2003
JP 2003250950 A 9/2003
JP 2004215806 A 8/2004
JP 2005198668 A 7/2005
JP 2005267625 A 9/2005
JP 2005296634 A 10/2005
JP 2007236995 A 9/2007
JP 2008161479 A 7/2008

(56) References Cited

FOREIGN PATENT DOCUMENTS

| | | | |
|---|---|---|---|
| JP | 2008188471 | A | 8/2008 |
| JP | 2009213520 | A | 9/2009 |
| WO | 199614115 | A1 | 5/1996 |
| WO | 1999043404 | A1 | 9/1999 |
| WO | 2001056670 | A1 | 8/2001 |
| WO | 0205914 | A1 | 1/2002 |
| WO | 02/064225 | A1 | 8/2002 |
| WO | 2002064225 | A1 | 8/2002 |
| WO | 2003026763 | A1 | 4/2003 |
| WO | 2009069708 | A1 | 6/2009 |
| WO | 2012053179 | A1 | 4/2012 |
| WO | 2012166197 | A1 | 12/2012 |
| WO | 2013116297 | A1 | 8/2013 |

OTHER PUBLICATIONS

Australian Patent Application No. 2015202960, Examination Report No. 1 dated Jun. 9, 2016.
Chinese Patent Application No. 201310220992.4, Notice of Allowance dated Jul. 4, 2016.
Koren Patent Application No. 10-2015-7007316, Notice of Allowance dated Jun. 16, 2016.
New Zealand Application No. 720973, First Examination Report dated Jul. 29, 2016.
Koren Patent Application No. 10-2015-7007553, Office Action dated Mar. 28, 2016.
New Zealand Patent Application No. 716059, First Examination Repor dated May 6, 2016.
Chinese Patent Application No. 201310225940.6, First Office Action dated Dec. 3, 2015.
New Zealand Patent Application No. 706311, First Examination Report dated Dec. 8, 2015.
Australian Patent Application No. 2008200596, Examiner's First Report dated Nov. 6, 2009.
Australian Patent Application No. 2010235931, Examiner's Report No. 2 dated Jul. 11, 2011.
Australian Patent Application No. 2013203307, Examination Report No. 1 dated Oct. 15, 2014.
Australian Patent Application No. 2013203316, Examination Report No. 1 dated Dec. 10, 2014.
International Application No. PCT/JP2005/003789, International Preliminary Report on Patentability dated Feb. 2, 2006.
International Application No. PCT/JP2005/003789, International Search Report dated Apr. 26, 2005.
International Application No. PCT/JP2012/006230, International Search Report dated Nov. 13, 2012.
International Application No. PCT/JP2013/004956, Written Opinion and International Search Report dated Sep. 24, 2013.
New Zealand Patent Application No. 704620, First Examination Report dated Jul. 31, 2015.
U.S. Appl. No. 10/542,073, Final Office Action dated Apr. 14, 2010.
U.S. Appl. No. 11/884,021, Non-Final Office Action dated Dec. 8, 2010.
U.S. Appl. No. 11/929,727, Non-Final Office Action dated Oct. 1, 2010.
U.S. Appl. No. 11/929,727, Non-Final Office Action dated Mar. 7, 2011.
U.S. Appl. No. 12/231,657, Non-Final Office Action dated Mar. 19, 2010.
U.S. Appl. No. 12/231,657, Final Office Action dated Dec. 8, 2010.
U.S. Appl. No. 12/825,261, Non-Final Office Action dated Nov. 23, 2010.
U.S. Appl. No. 13/914,404, Final Office Action dated Apr. 28, 2016.
U.S. Appl. No. 14/735,025, Final Office Action dated May 23, 2018.
U.S. Appl. No. 14/735,025, Non-Final Office Action dated Sep. 22, 2017.
U.S. Appl. No. 14/735,025, Non-Final Office Action dated Sep. 9, 2016.

* cited by examiner (a)

(b)

| | Marks | Out Puts of sensors |
|---|---|---|
| 1 | Blank<br>Blank | 320 OFF<br>321 OFF |
| 2 | Blank<br>Mark | 320 OFF<br>321 ON OFF |
| 3 | Mark<br>Blank | 320 ON OFF<br>321 OFF |
| 4 | M<br>M | 320 ON OFF<br>321 ON OFF |

FIG. 21

SYSTEM AND METHOD FOR DELIVERING PLAYING CARDS

CROSS-REFERENCE TO RELATED APPLICATIONS

The present application is a continuation from U.S. application Ser. No. 14/735,025 filed Jun. 9, 2015, which is a continuation from U.S. application Ser. No. 13/914,404 filed Jun. 10, 2013 (now U.S. Pat. No. 9,656,155), which is a continuation-in-part from International Application PCT/JP2012/006230 filed Sep. 28, 2012, and is a continuation-in-part of U.S. application Ser. No. 11/884,021 filed Aug. 9, 2007 (now U.S. Pat. No. 8,561,989), which is a national phase application under 35 USC § 371 of International Application PCT/JP2005/003789 filed Mar. 4, 2005, which claims priority to JP Application 2004-079519 filed Mar. 19, 2004; each of which is incorporated herein by reference.

FIELD OF THE INVENTION

The present invention relates to a method of delivering cards having a function of preventing erroneous drawing of a card in card games such as baccarat that are played using playing cards.

BACKGROUND OF THE INVENTION

Conventional card shoe apparatuses that are suitable for use in card games played in casinos or the like have been proposed. For example, a card shoe apparatus is disclosed in JP 1998-508236A in which a CCD image sensor and the related optical system components are incorporated in the card shoe. Also, a card reading window is provided in the exit of the card shoe. When a card passes through the exit of the shoe, the suit (type) and the rank (number) of the card are read through the card reading window.

However, such a conventional apparatus could not prevent a fraudulent act such as the insertion of false cards from the exit of the card shoe.

The present invention has been made in view of the above problem, and aims to provide a card shoe and a table game system with which it is possible to prevent the fraudulent insertion of cards into a card shoe used in the card game or the fraudulent dealing of cards, as well as the dealing of any card that should not be dealt onto the game table.

SUMMARY OF THE INVENTION

To solve the above conventional problems, the present invention provides a method of delivering cards including: a card housing step for housing a plurality of cards into housing unit of a card shoe apparatus; a delivering step for manually taking out cards one by one from an opening of the card housing unit; a card reading step that reads information of a card manually drawn out from the card housing unit onto a game table; a determination step of the winning/losing of the card game according to the rules of the card game based on the information of a card read in the card reading step and rules of a card game stored in a control unit that stores; and a card movement restriction step by a card movement restriction means that is provided in the opening unit and restricts the movement of a card from the card housing unit, wherein the card movement restriction includes: 1) a function of prohibiting the drawing out of a card at an inappropriate timing; and 2) a function of prohibiting the drawing out of a card when the card stands still (stopping) predetermined period of time at the opening of the card housing unit.

With the present invention, it is possible to provide a method of delivering cards capable of preventing, on site, any erroneous drawing or fraudulent act such as false or inappropriate dealing of cards, or the like.

BRIEF DESCRIPTION OF THE DRAWINGS

FIG. 20(*b*) is a cross-sectional view illustrating a main portion of a variation of the card movement restriction means according to another exemplary embodiment of the present invention that restricts the movement of cards from a card housing unit of the card shoe apparatus of FIG. 17 as viewed from the side.

FIG. 21 is a diagram illustrating the relation between output waves from sensors and marks of a card according to an exemplary embodiment of the present invention.

DETAILED DESCRIPTION

Figure 1:
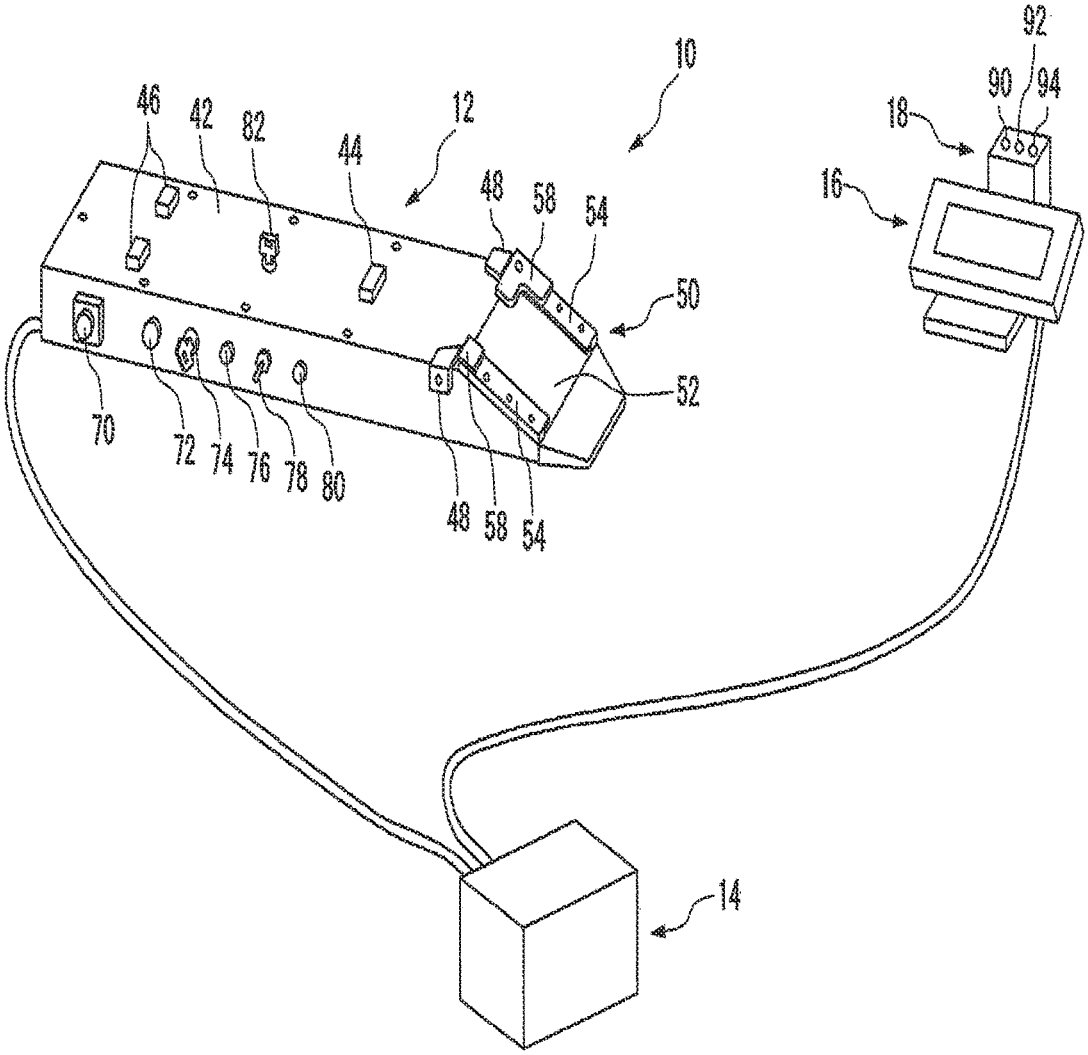
FIG. 1 is a view showing the overall configuration of a card reader of the present embodiment.

The following detailed description refers to the accompanying drawings. The following detailed description and the accompanying drawings do not limit the invention. Instead, the scope of the invention is defined by the appended claims.

A card reader includes a platform that is set on a game table and has a card shooter mounted thereon; a card guide unit that is provided in the platform to guide cards, which are pulled out one by one from the card shooter, onto the game table; and black light sensors that are provided in the card guide unit to read an ultraviolet-ray reaction code including the number of a card from the card.

According to this card reader, the platform is provided between the game table and the card shooter, and the platform is provided with a card reading function. Thus, reading of a card is enabled while the existing card shooter is utilized. Moreover, since the black light sensors are used, reading precision is high, and the threshold value of the card speed at the time of reading can also be set to a large value, for example, about 3.6 m/s. Also, the reading result of a card is suitably helpful to prevention of an illegal act.

Preferably, the card guide unit has a card guide surface, card guide rails are provided at edges of the card guide surface, a card passage gap is formed between the card guide surface and the card guide rails, and the black light sensors are provided so as to read a card from the card guide surface within the card passage gap. Accordingly, the influence of outside light in a card reading part can be reduced, and reading precision can be improved.

Preferably, the card reader further includes a win/lose determining means that determines the win or lose of a card game on the basis of the numbers of the cards that are sequentially read by the black light sensors, and an output means that outputs a game result determined by the win/lose determining means. Accordingly, the progress of a game can be supported, and an illegal act can be prevented.

Preferably, the card reader further includes an invalid mode setting means that sets a first card invalid mode that invalidates a card that is first pulled out in each game. Accordingly, even when a rule that invalidates a first card is adopted, the card reader can perform game result determination processing adapted to a card game, and can smoothly process a card game.

Preferably, the card reader further includes first and second card detecting sensors that are arranged along a guiding direction of the card guide unit to detect the existence or non-existence of a card, and a measurement validity/invalidity determining means that determines whether or not a card has normally passed along the card guide unit, on the basis of detection signals of the first and second card detecting sensors.

Preferably, the measurement validity/invalidity determining means validates reading of a card when the first card detecting sensor and the second card detecting sensor detect the card in order, and then the first card detecting sensor and the second card detecting sensor stop detecting the card in order.

Preferably, the measurement validity/invalidity determining means invalidates reading of a card when the first card detecting sensor and the second card detecting sensor detect the card in order, and then the second card detecting sensor and the first card detecting sensor stop detecting the card in order. Accordingly, when a card slips back, it is possible to suitably cope with this.

Preferably, in the card reader, the sensitivity of the second card detecting sensor is set so as to detect a card for game and so as not to detect a cut card. Accordingly, when a cut card is used, the card reader can suitably cope with this.

Further, in the card reader, the black light sensors are adapted to detect code elements including a given number from a card which the code elements are arrayed in a card pulling direction as an ultraviolet-ray reaction code, and to output a detection signal. Also, the card reader includes a number specifying means, and the number specifying means specifies a card associated with the numbers of the code elements on the basis of the detection signals of the black light sensors. The code elements are typically marks printed with ultraviolet-ray reaction ink. The code elements may be spaced apart from an edge of the card in a direction across a card pulling direction.

The numbers of the code elements are associated with at least the number of a card. The numbers of the code elements may be associated with the suit (spade, heart, etc.) of a card, in addition to the number of the card. The numbers of the code elements may be associated with other information.

Further, the ultraviolet-ray reaction code may have plural rows of the code elements. The plural rows of code elements may be stacked inwardly from an edge of the card. A card may be specified by a combination of the numbers of the plural rows of code elements. In this case, a card is specified from the plural rows of code elements including given numbers. Accordingly, even in this case, the code elements including given numbers are read. Also, the number specifying unit specifies the number of a card associated with the numbers of the code elements.

Since the black light sensors are provided, the code elements are detected by the black light sensors, and a card is specified from the numbers of the code elements, the card can be detected with high precision.

A card shooter apparatus has a card reading function to read the number of a card. This card shooter apparatus includes black light sensors that read an ultraviolet-ray reaction code including the number of each of cards that are pulled one by one from a card shooter, from the card. In this aspect, the card shooter and the card reader may be provided separately or integrally. Even in this aspect, an advantage that reading precision can be improved is obtained, and an advantage that the threshold value of the card speed at the time of reading is raised is obtained.

The card shooter apparatus may further include a housing, a card shooter unit that is provided in the housing, and a card guide unit that is provided in the housing to guide cards pulled out one by one from the card shooter unit onto a game table. Here, the black light sensors are provided in the housing. The black light sensors may be provided in the housing. The housing may include a processing unit that processes the read data of the black light sensors, and a display unit that displays a processing result of the processing unit.

Hereinafter, embodiments of the invention will be described with reference to the drawings.

FIG. 1 shows a card reader 10 of the present embodiment. The card reader 10 includes a platform 12, a control box 14 is connected to the platform 12, and a monitor 16, and a win/lose display box 18 are connected to the control box 14. The control box 14 is a computer apparatus that controls the whole apparatus.

Figure 2:
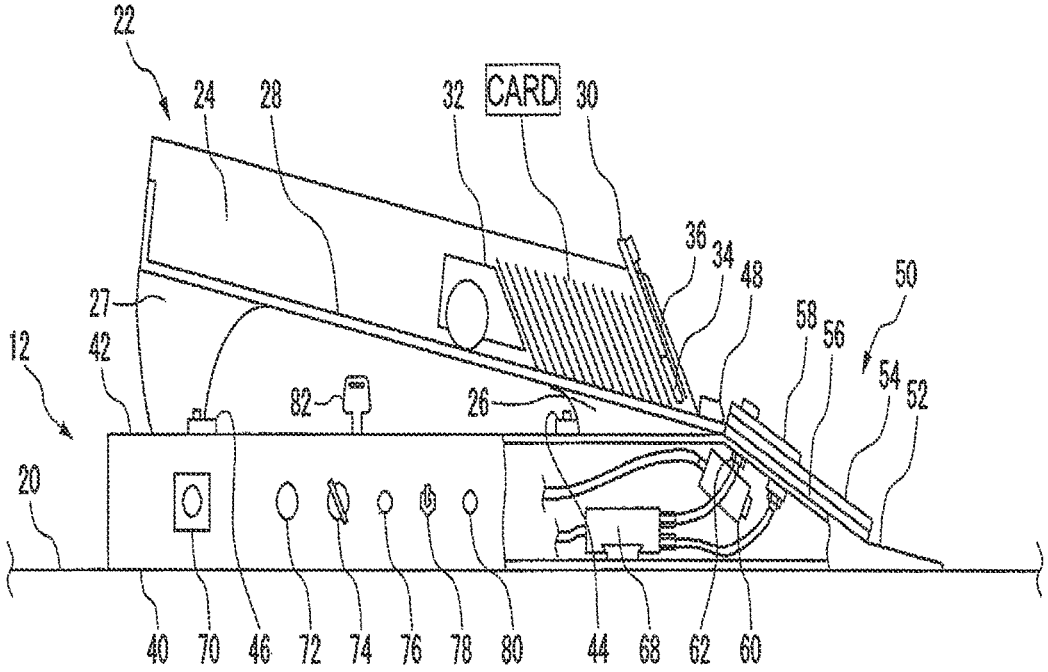
FIG. 2 is a view showing a platform along with a game table and a card shooter.

Referring to FIG. 2, the platform 12 is set on a game table 20, and a card shooter 22 (card shoe) is mounted on the platform 12.

Figure 3:
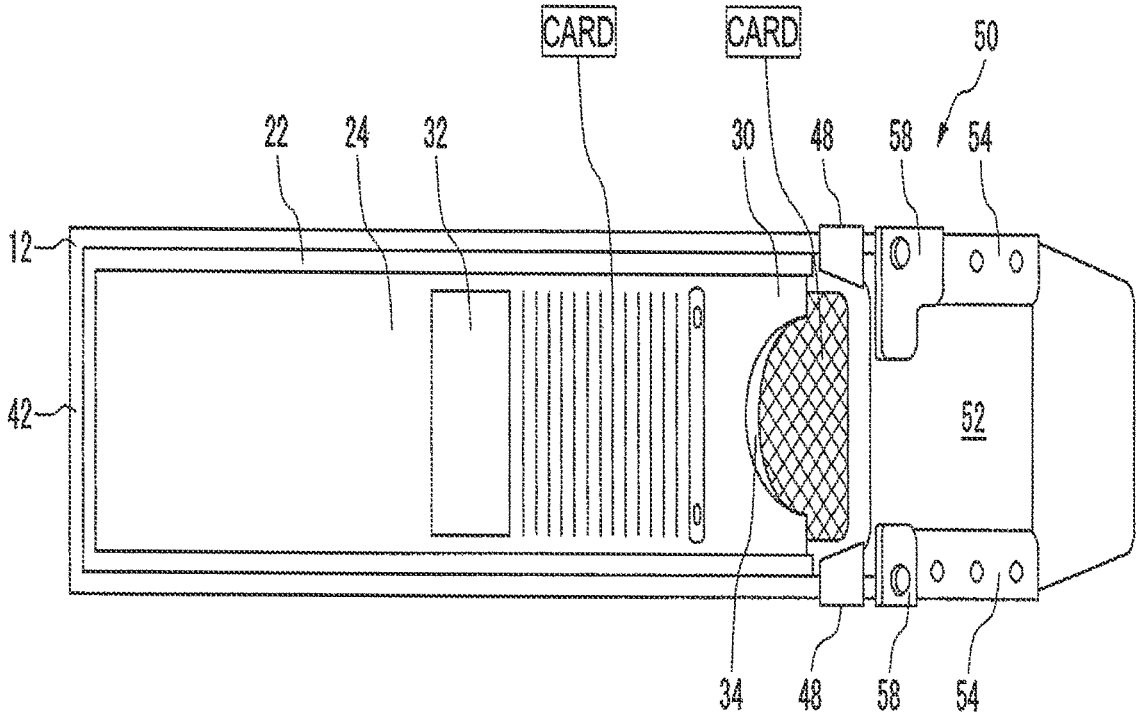
FIG. 3 is a plan view of the platform and the card shooter.

The card shooter 22 may be a general type of existing shooter. The card shooter 22 includes a card housing 24, and a fore leg 26 and a hind leg 27 under the card housing. A floor 28 and a front wall 30 of the card housing 24 incline as shown. Within the card housing 24, a deck of cards is forward pushed against the front wall 30 by a card push member 32 with a roller. The front wall 30, as shown in FIG. 3, has a U-shaped opening 34 in a lower part. A dealer slides the cards to take them out of the opening 34.

In addition, black cloth 36 (omitted in the other drawings) is hung on the front wall 30 so as to block the opening 34. Further, though not shown, a cover is attached to an upper part of the card housing 24. The card shooter 22 is black as a whole, and is made of resin.

Next, the configuration of the platform 12 will be described. The platform 12 is black and is made of resin, similarly to the card shooter 22. The platform 12 has a thin box shape as a whole. The platform 12 has a table mounting surface 40 at the bottom thereof, and a shooter setting surface 42 at the top thereof, and both the surfaces are flat.

The shooter setting surface 42 is provided with shooter positioning blocks 44 and 46. The card shooter 22 is put on the shooter setting surface 42 so that the fore leg 26 and the hind leg 27 of the card shooter 22 may contact the shooter positioning blocks 44 and 46, and thereby, the card shooter 22 is positioned with respect to the platform 12.

Further, shooter hold-down blocks 48 are attached to a front end of the shooter setting surface 42. The shooter hold-down blocks 48 holds down the front end of the card shooter 22 from upside, and thereby, the card shooter 22 is held on the platform 12.

The platform 12 has a card guide unit 50 in a front part thereof. The card guide unit 50 guides cards, which are pulled out one by one from the card shooter 22, onto the game table 20, as described below.

As shown in FIGS. 2 and 3, the card guide unit 50 has a card guide surface 52 that is an inclined plane. One end of the card guide surface 52 is connected with an opening 34 of a card outlet of the platform 12. The card guide surface 52 extends forward and downward from the front the card outlet, and the other end of the card guide surface is connected with the game table 20. The card guide surface 52 becomes a measurement surface for card reading.

Card guide rails 54 are attached to edges on both sides of the card guide surface 52. As shown in FIG. 2, a card passage gap 56 is formed between the card guide rails 54 and the card guide surface 52. The size of the card passage gap 56 is set to be slightly larger than the thickness of a card. After a card is pulled out of the card shooter 22, it passes along the card guide surface 52. At this time, both ends of the card pass through the card passage gap 56.

Further, the inclination of the card guide surface 50 is changed on the way as shown. The card guide rails 54 are provided in a region before the inclination changes, and the card guide rails 54 is slightly longer than the short sides of a card.

Figure 4:
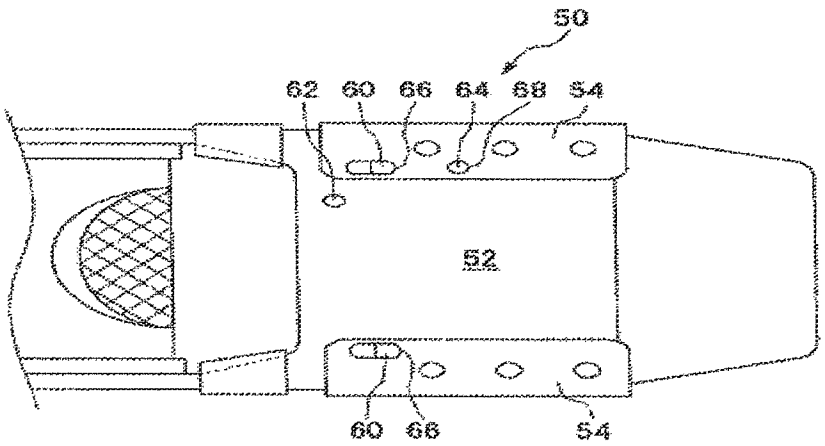
FIG. 4 is a plan view in a state where a sensor cover is detached.

Further, a sensor cover 58 is attached to each of the two card guide rails 54 with screws. As shown in FIG. 4, when the sensor covers 58 are detached, four sensors are exposed. The sensor covers 58 protect the sensors form outside light. The four sensors are two black light sensors 60, an object detecting sensor 62, and a measurement validity determining sensor 64, and these sensors are provided in the card guide surface 52 of the card guide unit 50. In the drawing, the black light sensors 60 and the measurement validity determining sensor 64 can be seen from sensor cleaning holes 66 and 67 that pass through the card guide rails 54.

Figure 5:
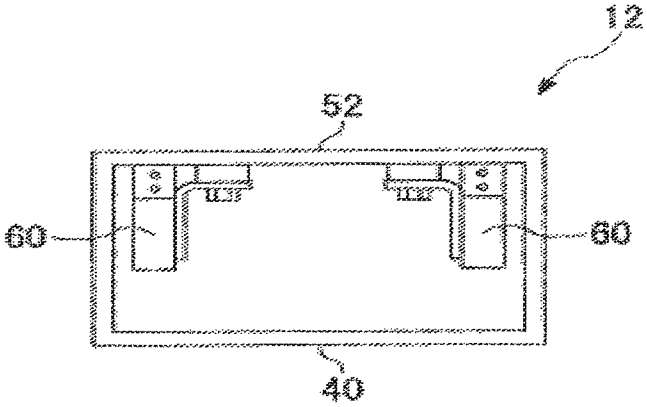
FIG. 5 is a sectional view of the platform.

As shown in FIG. 4, the black light sensors 60 (hereinafter referred to as UV sensors 60) are located on the relatively upstream side in the direction of flow of a card, on the card guide surface 52. Further, as shown in FIGS. 2 and 5, the UV sensors 60 are arranged in the inner space of the platform 12, are fixed to the ceiling (the other side of the card guide surface 52) of the platform with stays, and are exposed through the opening of the card guide surface 52.

Each of the UV sensors 60 includes an LED (ultraviolet LED) that emits ultraviolet rays, and a detector. A card is irradiated with ultraviolet rays (black light), and a code of the card is detected by the detectors. The code of the number (rank: A, 1 to 10, J, Q, and K) of a card is printed on the card with ultraviolet ray emission ink that produces a color when ultraviolet rays strike the card.

The above UV sensors 60 are connected to the control box 14 through cables. In the control box 14, the number of a card is determined from output signals of the detectors of the UV sensors 60.

Figure 13:
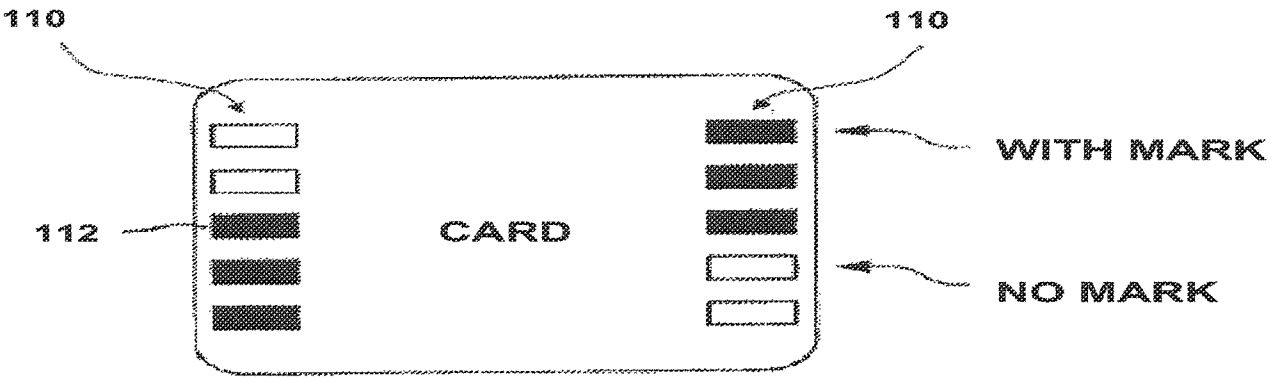
FIG. 13 is a view showing an example of a card.
Figure 15:
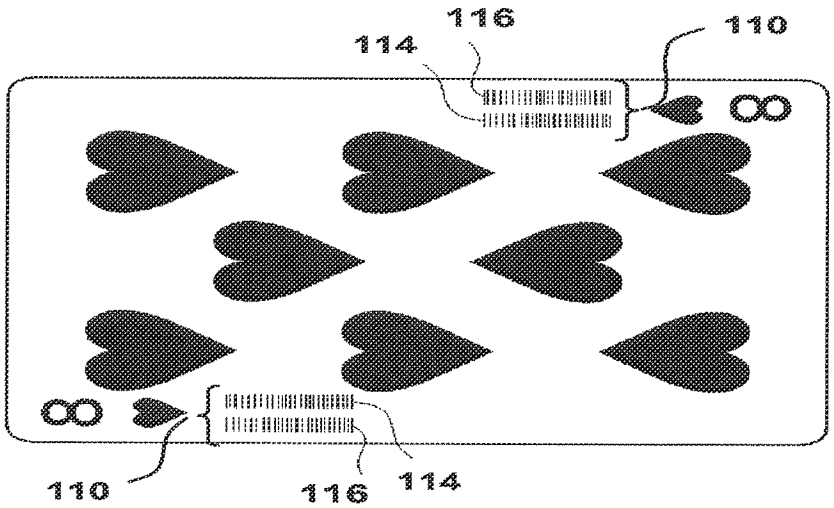
FIG. 15 is a view showing an example of a card.
Figure 16:
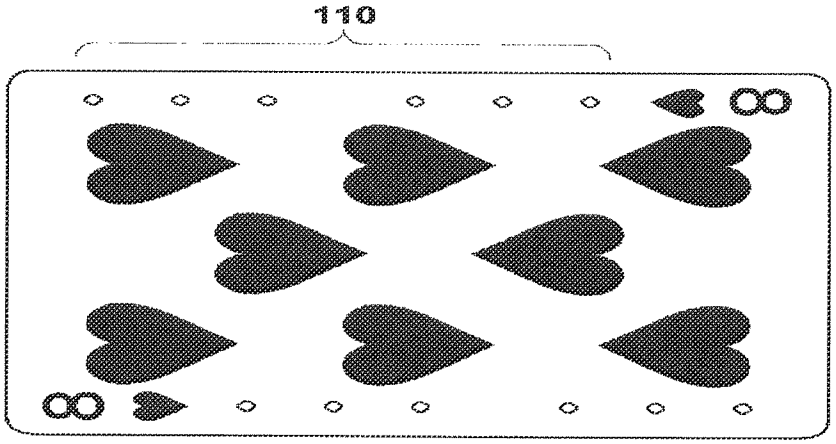
FIG. 16 is a view showing an example of a card.

Here, as the code 110 for the number of a card, for example, a plurality of code elements 112 are arrayed on edges of the card such as shown in FIGS. 13, 15, and 16. For example, the code elements 112 may be quadrangular marks, circular marks, or the like which are printed in ultraviolet ray emission ink.

The number of the card is expressed by the numbers of the marks. The UV sensors 60 output ON signals when the marks are detected. Accordingly, the UV sensors 60 on both edges output ON signals of the numbers of the marks. In the control box 14, the ON signals input from the two UV sensors 60 are counted. Thereby, the two mark numbers detected by the two UV sensors 60 are obtained. Also, the control box 14 specifies the number of a card from the numbers of the marks.

In addition, although the numbers of marks and the number of a card may be the same as each other, they may not be the same as each other. The numbers of the marks and the number of a card only need to match each other one-on-one. In the control box 14, a detected mark number is compared with a mark number that is registered in advance, and thereby, the number of a card may be specified.

Further, in the baccarat game, "J", "Q", and "K" are treated as equal to "10." Thus, the same code as "10" may be attached to "J", "Q", and "K." Further, in addition to the number of a card, a code representing a suit (spades, hearts, diamonds, and clubs) may be attached to a card, and this may be read. In this way, the type of codes is not limited if the numbers of cards required for a game are expressed.

As described above, in the present embodiment, the card reader 10 includes the UV sensors 60 that detects marks from a card and outputs signals. The above UV sensors 60 output ON signals during passage of marks. Marks including a given number are provided on a card, and the marks are provided on the edges of the card, and thereby arrayed in a card pulling direction so that they may pass through the UV sensors 60. Then, the number of the marks is associated with the number of the card, and the control box 14 specifies the card from detection signals of the UV sensors 60.

Further, as described above, in the card reader 10 of the present embodiment, the two UV sensors 60 are provided as shown in FIGS. 4 and 5. Then, as shown in the example of FIG. 13, marks are arrayed on both edges of a card in correspondence with both the UV sensors 60, and the marks are read by both the UV sensors 60. The marks are suitably provided in a region where a picture is not provided as shown. However, actual marks are not usually visible.

As described above, in the present embodiment, marks including a given number are suitably arrayed on each edge of a card. As for the association between a mark number and a card, the sum of mark numbers may simply be associated with the number of a card. Further, a combination of two rows of mark numbers may be associated with the number of a card. In the latter form, it is possible to identify more cards by few marks. Moreover, one of the rows may be associated with a number of the card and the other row may be associated with a suit of the card. In addition, FIG. 13 is just illustrative, and the number of mark rows is not limited to two, but the number of rows may be one or three or more.

Also, two mark rows 114 and 116 may be suitably provided on each of both edges of a card as shown in FIG. 15. In this case, the arrangement of the UV sensors is also properly adjusted.

Further, additionally describing the configuration of the control box 14, the control box 14 of the card reader 10 includes a counter, a memory (storage means), and a number specifying unit. The counter counts detection signals from the UV sensors 60, and finds out a mark number. Also, the memory stores information that associates the mark number with a card. The associated information is typically a table. The number specifying unit specifies the number of a card from the numbers of marks with reference to the information of the memory.

In the present embodiment, the counter is able to find out two mark numbers corresponding to the two UV sensors 60. As described above, in the present embodiment, a combination of a plurality of rows of mark numbers may be associated with a card. In this case, a memory stores information that associates the combination of the mark numbers with a card. Also, the number specifying unit specifies a card corresponding to the combination of the card numbers.

Figure 6:
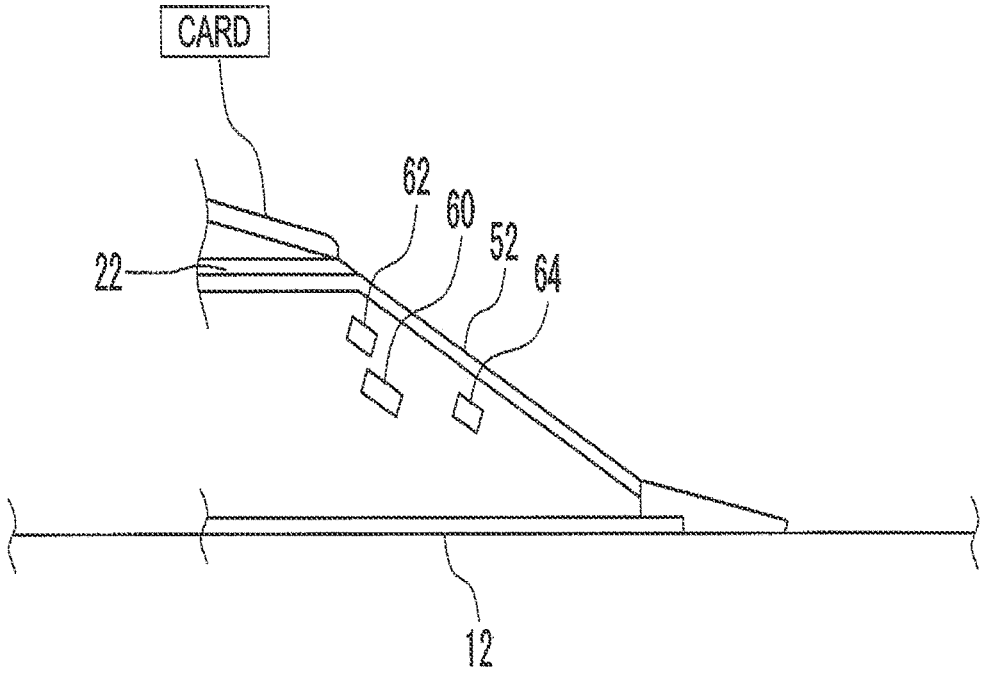
FIG. 6 is a view showing a sensor arrangement.

Next, the object detecting sensor 62 and the measurement validity determining sensor 64 are fiber sensors that detect the existence or non-existence of a card. The object detecting sensor 62 is located on the most upstream side along the flow direction of a card on the card guide surface 52, and the measurement validity determining sensor 64 is located on the downstream side of the object detecting sensor 62. Also, as shown in FIG. 6, the object detecting sensor 62 and the measurement validity determining sensor 64 are provided on the upstream and downstream sides of reading points of the UV sensors 60. The object detecting sensor 62 and the measurement validity determining sensor 64 correspond to a first card detecting sensor and a second card detecting sensor, respectively.

Further, similarly to the UV sensors 60, the object detecting sensor 62 and the measurement validity determining sensor 64 are arranged in the inner surface of the platform 12, are fixed to the ceiling of the platform, and are exposed through the opening of the card guide surface 52.

The object detecting sensor 62 and the measurement validity determining sensor 64, as shown in FIG. 2, are connected to the control box 14 by cables via a sensor amplifier 68. The sensor amplifier 68 is of a two channel type, and is able to independently control the object detecting sensor 62 and the measurement validity determining sensor 64. On the basis of detection signals of the object detecting sensor 62 and the measurement validity determining sensor 64, the control box 14, as will be described below, controls the start and end of reading of the UV sensors 60, and determines whether or not a card has normally passed along the card guide surface 52.

Figure 7:
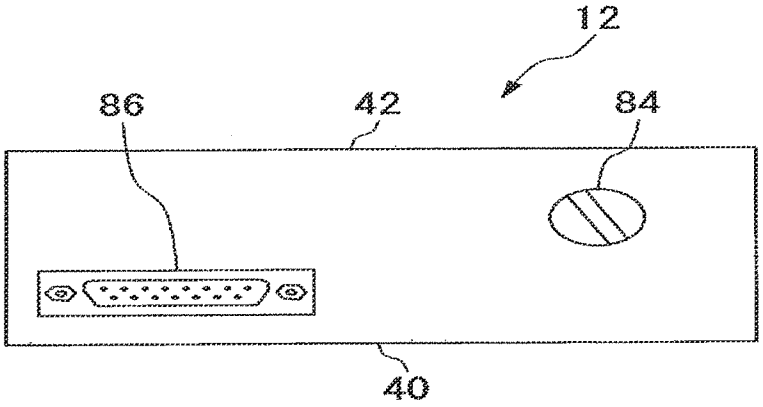
FIG. 7 is a view showing the back surface of the platform.

Further, as shown in FIG. 2, a side surface of the platform 12 is further provided with a buzzer 70, a push button 72 with a lamp, a reset switch 74, an error lamp 76 (red), a monitor changeover switch 78, and a normal lamp 80 (green). In the push button 72 with a lamp, the lamp is turned on or turned off whenever the button is pushed. The reset switch 74 is a switch of a type in which a key inserted into a keyhole is turned, and the monitor changeover switch 78 is a lever switch. Further, the upper surface of the platform 12 is provided with a standard/special mode changeover switch 82. This switch 82 is also a switch of a type in which a key inserted into a keyhole is turned. Further, as shown in FIG. 7, the back surface of the platform 12 is provided with a power switch 84 and a cable connector 86. The above various switches, lamps, buzzer, etc. are connected to the control box 14 through cables, and are used for various kinds of processing of the control box 14.

The configuration of the platform 12 has been described hitherto. As shown in FIG. 1, the card reader 10 is further provided with the monitor 16 and the win/lose display box 18.

The monitor 16 is controlled by the control box 14 to display the information on reading of a card, and a game. The win/lose display box 18 is provided with three lamps, i.e., a player-win lamp 90 (red), a draw lamp 92 (yellow), and a banker-win lamp 94 (green). These lamps are controlled by the control box 14, and they are turned on or off in order to display the win or lose of a game. As shown in this description, the card reader 10 of the present embodiment is applied to a baccarat game.

Further, the monitor 16 and the win/lose display box 18 are set in a proper location on the game table 20. On the other hand, the control box 14 is arranged in a proper location, such as the underside of the game table 20.

Figure 8:
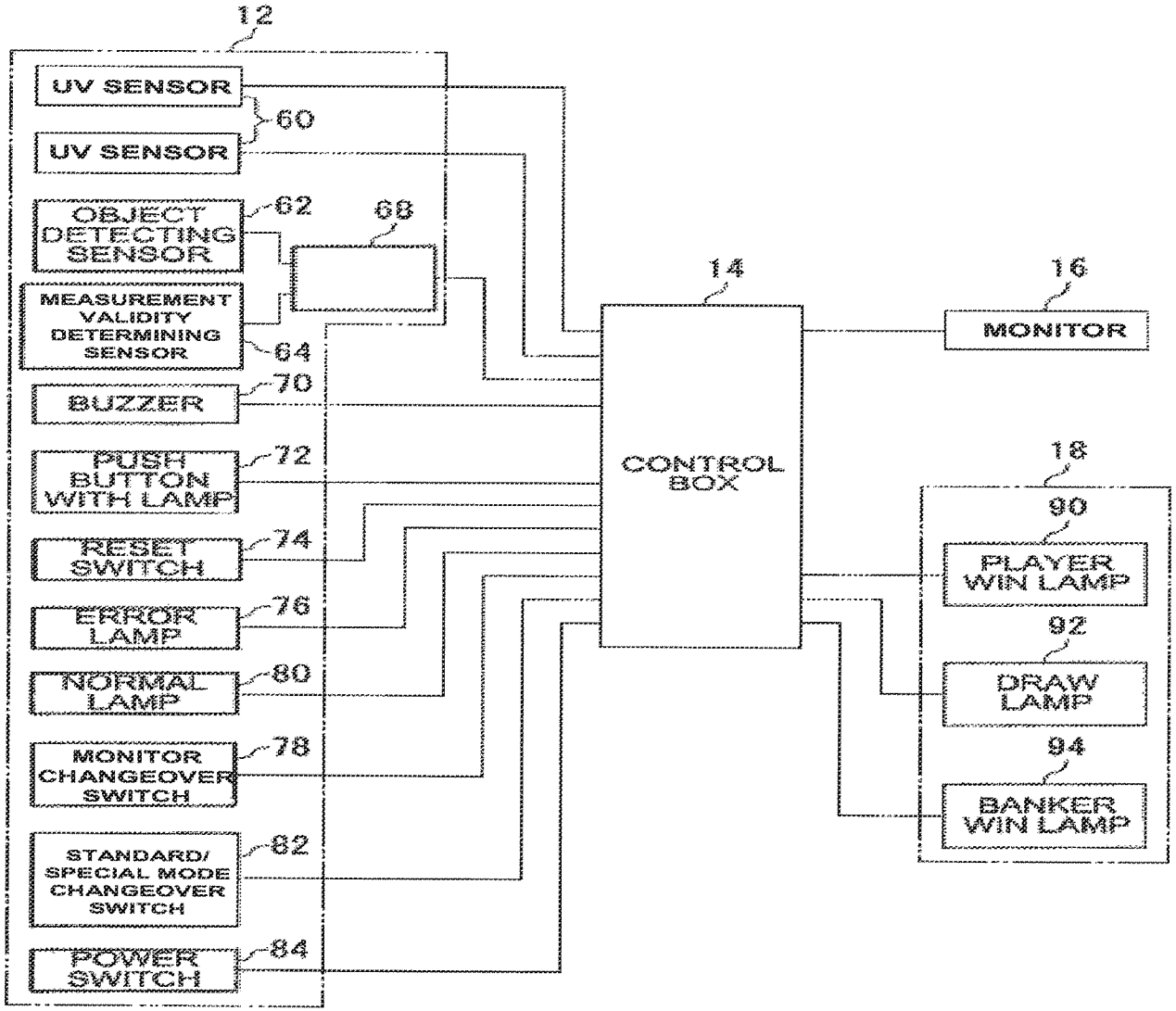
FIG. 8 is a block diagram showing a control configuration including a control box.

FIG. 8 is a functional block diagram of various components relevant to the control box 14. The control box 14 is a computer apparatus as earlier mentioned. The control box 14 is connected to the UV sensors 60, object detecting sensor 62, and measurement validity determining sensor 64 of the platform 12. Moreover, the control box 14 is connected to the various switches and lamps of the platform 12 to control them. Further, the control box 14 is connected to the monitor 16 and three lamps of the win/lose display box 18 to controls the display of them.

A computer serving as the control box 14 has a processing function to automatically determine win or lose of a game. This function is realized by incorporating a program for win/lose determination into the computer, and this program is executed by a processor of the computer.

As determination processing, the computer acquires the numbers of cards, which are sequentially taken out of the card shooter 22 to the game table 20, using the UV sensors 60. The acquired numbers of the cards are sequentially stored in the memory. At this time, the information on to which player each card has been distributed is also stored. That is, the numbers of cards are stored in association with distribution destinations.

From this point, the card reader 10 of the present embodiment is used in a baccarat game as earlier mentioned. In the baccarat game, two persons including a player and a banker exist (here, both are called players). Also, to which player the next card is to be distributed is uniquely determined from the number of cards distributed by then, and the number of each of the cards. The computer determines to which player a card read by the UV sensors 60 is to be distributed with reference to the numbers of the cards stored in the memory. Also, the number of the distributed card is stored in the memory in association with each player.

Moreover, the computer reads the numbers of the cards, which have been distributed to both players, from the memory, compares the numbers of the both players, and determines a win or lose. The numbers of the cards are summed, both sums are compared, and which player has won is determined. A draw is also determined.

As such, concerning the baccarat game, win or lose can be automatically determined only from the numbers of the cards sequentially taken out of the card reader 10. To which player a card has been distributed may not be detected using other sensors, for example, sensors separately embedded in the table.

The control box 14 causes a game result to be output to the monitor 16 and the win/lose display box 18. Read numbers, a game result, etc. are displayed on the monitor 16. Further, in the win/lose display box 18, a banker-win lamp 90, a draw lamp 92, or a player-win lamp 94 are turned on according to the game result.

Next, the functions of the object detecting sensor 62 and measurement validity determining sensor 64 will be described. As already described, the object detecting sensor 62 and the measurement validity determining sensor 64 detect the existence or non-existence of a card, and output detection signals to the control box 14. In the present embodiment, if a card exists, a signal is turned on, and if a card disappears, a signal is turned off.

First, the detection signal of the object detecting sensor 62 is used to control the start and end of reading of the UV sensors 60. That is, when the object detecting sensor 62 detects a card (from OFF to ON), the control box 14 instructs the UV sensors 60 to start reading. In the UV sensors 60, an LED is turned on, and a detector reads code. When the object detecting sensor 62 stops detecting a card (from ON to OFF, the control box 14 instructs the UV sensors 60 to end reading. In the UV sensors 60, an LED is turned off.

The object detecting sensor 62 and the measurement validity sensor 64 are used to judge an attitude of the card. This judgment is made in order to judge whether the card is sliding with a side of the card being in contact with the card guide rails 54 or not. It is judged that the card passed through in an appropriate attitude when: (1) the object detecting sensor 62 and the measurement validity sensor 64 detect the card in order; (2) these sensors detect that the card passed through (the card became nonexistent) in order; and (3) the object detecting sensor 62 and the measurement validity sensor 64 detect the card at the same time. In other cases, it is judged that the card did not pass through in an appropriate attitude. This judgment process is performed by the computer of the control box 14. The result of the judgment of a card attitude may be indicated, for example by turning on or off a lamp to indicate that the attitude was appropriate or not.

Algorithms for the attitude judgment are not limited to the above. For example, it may be judged that an attitude is appropriate even if not all the above conditions are met. However, using the above conditions allows the attitude judgment to be more correct.

The object detecting sensor 62 and the measurement validity determining sensor 64 are further used to determine whether or not a card has normally passed along the card guide surface 52.

Figure 9:
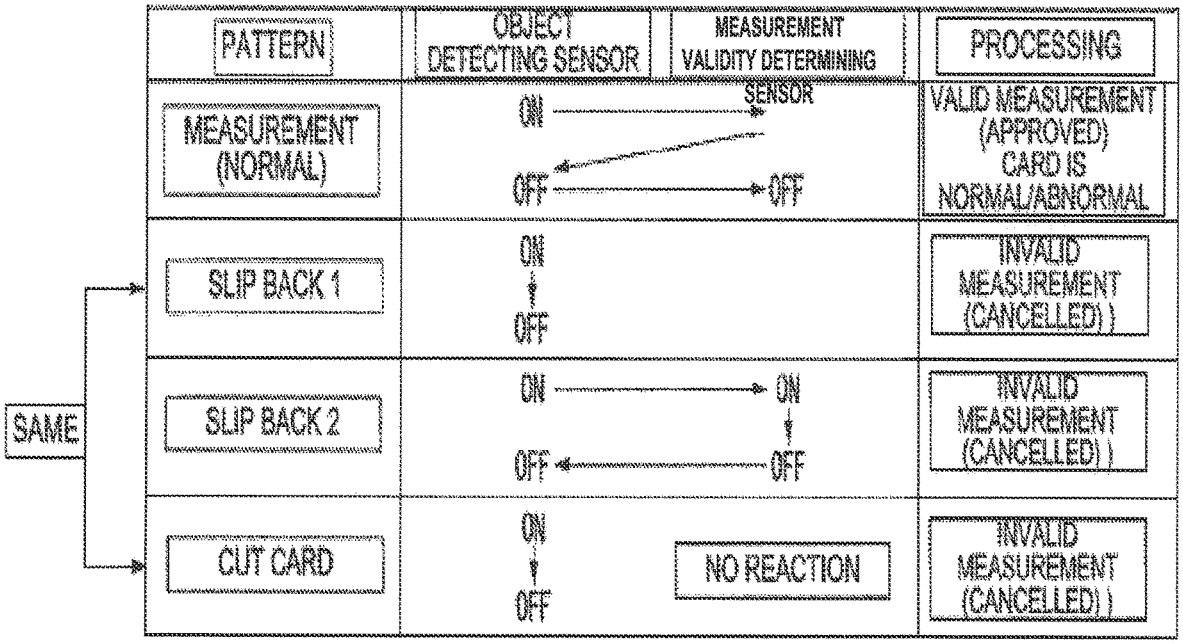
FIG. 9 is a view showing sensor output according to situations.

The first step of FIG. 9 shows a sensor output when (when a card has normally passed along the card guide surface) measurement is normal. In this case, a signal is turned on in order of the object detecting sensor 62 and the measurement validity determining sensor 64, and then, the signal is turned off in order of the object detecting sensor 62 and the measurement validity determining sensor 64. The reading result (measurement result) of the UV sensors 60 is valid (reading is approved).

However, if passage of a card is normal, but a mark number read by the UV sensors 60 read is abnormal, the control box 14 determines that the card itself is abnormal. For example, a card is abnormal when there is no mark at both edges of the card. The numbers of marks may be registered, and be compared with a detected mark number.

The second step of FIG. 9 shows a sensor output when a card slightly comes out onto a card guide, and slips back. The object detecting sensor 62 is turned on, and then, the object detecting sensor 62 is turned off. Since a card has not reached the measurement validity determining sensor 64, the measurement validity determining sensor 64 is not turned on. In this case, the reading result of the UV sensors 60 is invalidated.

The third step of FIG. 9 shows a sensor output when a card slips back after the card has reached the measurement validity determining sensor 64. A signal is turned on in order of the object detecting sensor 62 and the measurement validity determining sensor 64, and then, the signal is turned off in order of the measurement validity determining sensor 64 and the object detecting sensor 62. Even in this case, the reading result of the UV sensors 60 is invalidated.

The fourth step of FIG. 9 shows a sensor output when a cut card is taken out. Here, the cut card is a card used in a casino, etc., and is inserted into a deck of cards. Cards following the cut card are not used for a game. If this cut card is not disregarded, a read error is generated. Then, in order to disregard the cut card, the present embodiment is configured as follows.

Blue is given to the cut card. The sensitivity of the object detecting sensor 62 is adjusted so as to detect white and a mark color (a color when ultraviolet-ray reaction ink produces a color) as well as a blue object. On the other hand, the sensitivity of the object detecting sensor 64 is adjusted so as not to detect a blue object but to detect a white object and an object with a mark color. This is realized by lowering the sensitivity of the measurement validity determining sensor 64.

Since such sensitivity setting has been performed, when a cut card passes by as shown in the fourth step of FIG. 9, the object detecting sensor 62 is turned on, and then turned off. The measurement validity determining sensor 64 does not react. Accordingly, the same sensor output as the second step of FIG. 9 is obtained, and accordingly, reading of the UV sensors 60 is invalidated. In this way, passage of a cut card can be suitably disregarded.

In addition, although a cut card is blue in the above example, the invention is not limited thereto. A separate color may be given as long as it can adjust sensor sensitivity so that only a cut card may not be detected.

Figure 10:
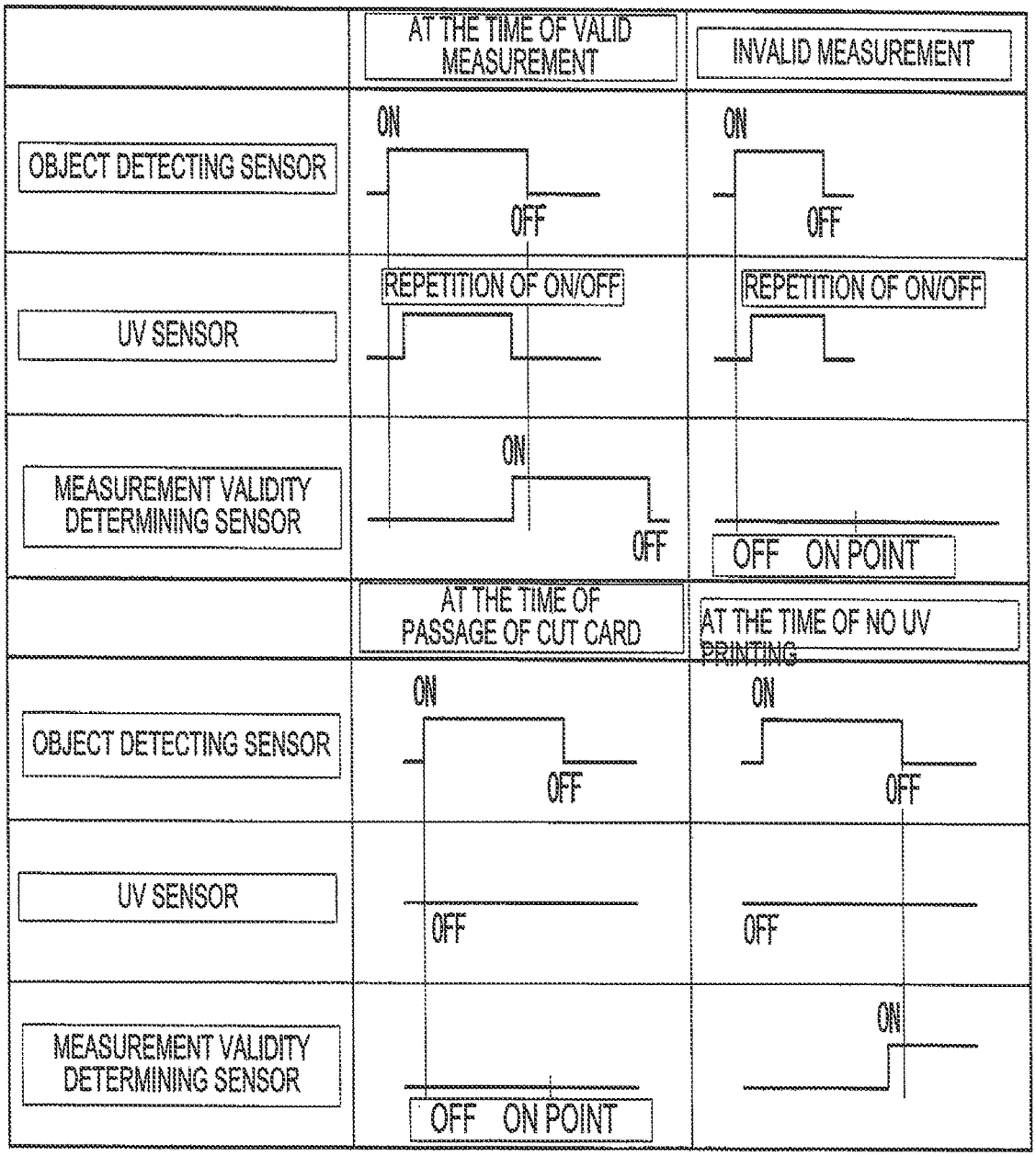
FIG. 10 is a view showing an example of the output waves of sensors.

FIG. 10 shows examples of the above-mentioned sensor output waves. When measurement is valid, the object detecting sensor 62 and the measurement validity determining sensor 64 are normally turned on and off as described above. Also, the UV sensors 60 are turned on and off during the measurement (during "ON" of the object detecting sensor 62), and the number of a card is found out from ON/OFF signals of the UV sensors 60.

Since the card slips back in the following pattern, the object detecting sensor 62 is turned off before the measurement validity determining sensor 64 is turned on. Therefore, the reading result of the UV sensors 60 during the measurement is invalidated.

Since the cut card has passed along the card guide surface in the following pattern, only the object detecting sensor 62 is turned on and off, similarly to the above pattern. The UV sensors 60 do not output any ON signal. Even in this case, the reading result is invalidated.

Since a card on which a code is not printed has passed along the card guide surface in the following pattern, the object detecting sensor 62 and the measurement validity determining sensor 64 are normally turned on and off, but the UV sensors 60 are kept turned off during the measurement. In this case, the control box 14 determines that an abnormal card has passed along the card guide surface.

The functions of sensors have been described hitherto in detail. Next, the operation of the card reader 10 of the present embodiment will be described.

Figure 11:
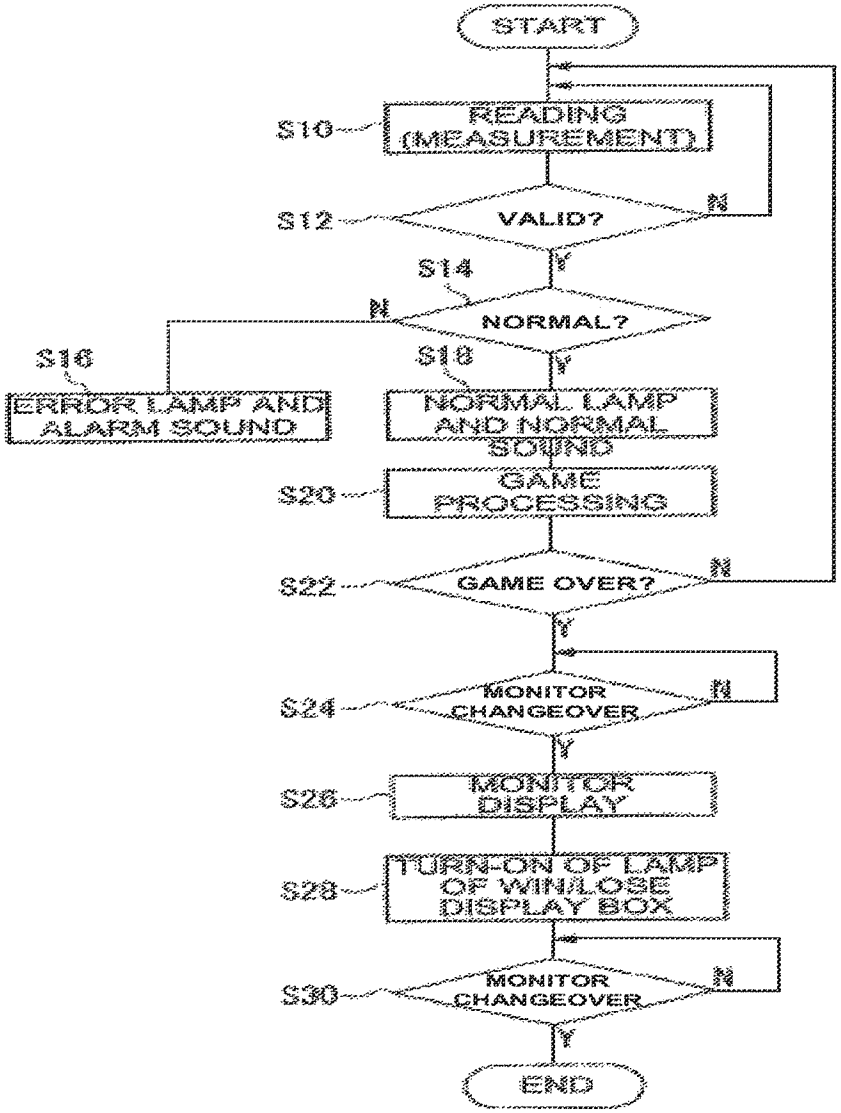
FIG. 11 is a flow chart showing the operation of the card reader when a normal mode is set.

FIG. 11 shows the operation of the card reader 10 when one game is performed. The power switch 84 is turned on as a precondition of the operation of FIG. 11. Further, the lever of the monitor changeover switch 78 is tilted to a position "before a game," and the "before a game" is displayed on the monitor 16. Moreover, the key of the reset switch 74 is turned to the left that is a normal position. Further, the standard/special mode setting switch 82 is turned to the standard side.

A first card is read in this state (S10). It is determined whether or not reading (measurement) has been valid (S12) on the basis of the output of the object detecting sensor 62 and the measurement validity determining sensor 64. If the answer is NO (invalid) in S12, the process returns to S10. For example, when a card has slipped back or a cut card has passed along the card guide surface, the process returns to S10 from S12.

If the answer is YES (valid) in S12, it is determined whether or not the code of the card is normal (S14). For example, if there is no code, the answer is set to NO in S14. In this case, the error lamp 76 is turned on, and an alarm sound is emitted from the buzzer 70 (S16). An alarm sound is, for example, a large volume of continuous sound. If a reset switch 74 is operated, the alarm sound will stop. The reset switch 74 is turned to the right from the left, and slips back to the left.

If the is YES (normal) in S14, the normal lamp 80 is turned on, and a sound indicating normality from the buzzer 70 is emitted (S18). For example, a short small sound is output.

Next, game processing is performed (S20). Here, as earlier mentioned, the read number of the card is stored for a player or a banker. Then, the number of the card that is stored in advance is compared, it is determined whether or not the game is ended, and the win or lose of the game is determined. If the game is not ended (S22, NO), the process returns to S10 where the next card is read. If the game is ended (S22, YES), the process will wait for the operation of the monitor changeover switch 78 (S24).

Also, if the lever of the monitor changeover switch 78 is tilted to a position "after a game" (S24, YES), the display of the monitor 16 is switched to "after a game," and a win or lose is displayed (S26). Further, even in the win/lose display box 18, a lamp corresponding to a game result is turned on (S28).

If the lever of the monitor changeover switch 78 is tilted to a position "before a game" (S30, YES), the display of the monitor 16 is changed to "before a game," and the processing is completed. Then, the process proceeds to the next game, and the processing of FIG. 11 is performed again.

Figure 12:
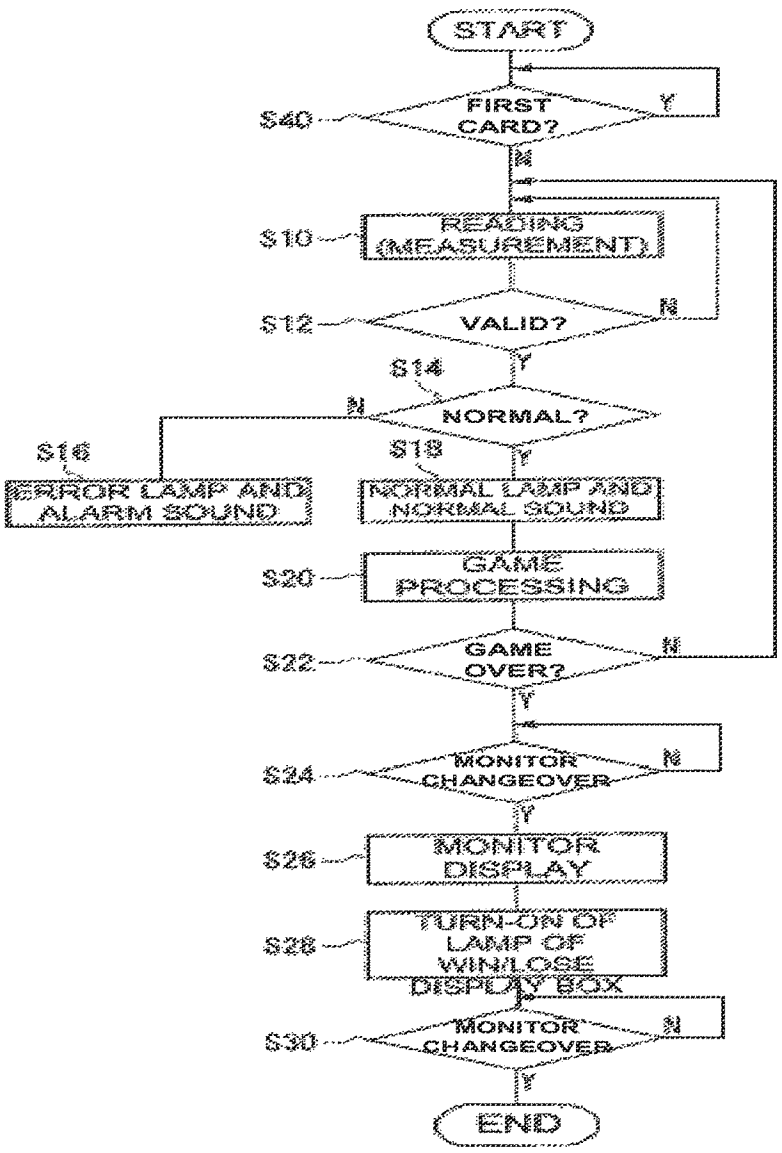
FIG. 12 is a flow chart showing the operation of the card reader when a special mode is set.

FIG. 12 shows the operation of the card reader 10 when a special mode is set. The special mode is set by the control box 14 when the standard/special mode changeover switch 82 is turned to "Special." The special mode is a first card invalid mode in which a card that is first pulled out in each game is invalidated.

FIG. 12 is different from FIG. 11 in that it is first determined whether or not any card is first just before S10 (S40). Here, for example, the object detecting sensor 62 and the measurement validity determining sensor 64 are turned on in this order, and turned off in this order. As a result, when a card has passed along the card guide surface, it is determined whether or not this card is first. If a card is first, the process does not proceed to S10 but returns to S40. If a card is not first, the process proceeds to S10. Accordingly, the second and succeeding cards are read.

Whether or not a card is first is determined, for example, using a flag. That is, when the flag is not raised in the processing of S40, it is determined that the card is first, and the flag is raised. Also, if the flag is raised, it will be determined that the card is not first. The flag is reset after the game is ended.

In addition, in the push button 72 with a lamp in the platform 12, a lamp is turned on or turned off whenever the button is pushed. When the button 72 is turned off, the card reader 10 reads a card as described above. On the other hand, when the button 72 is turned on, the card reader 10 does not read a card. The button 72 is used, for example, when reading of the card reader 10 is temporarily suppressed.

The preferred embodiment has been described hitherto. According to the present embodiment, the platform 12 is provided between the game table 20 and the card shooter 22, and the platform 12 is provided with a card reading function. Thus, reading of a card is enabled while the existing card shooter 22 is utilized. Moreover, since the black light sensors 60 are used, reading precision is high, and the threshold value of the card speed at the time of reading can also be set to a large value, for example, about 3.6 m/s. In this way, a card reader that is capable of utilizing an existing card shooter, is high in reading precision, and is high in the threshold value of the card speed at the time of reading can be provided. Also, the reading result of a card is suitably helpful to prevention of an illegal act.

Further, in the present embodiment, the card guide 50 has the card guide surface 52, the edge of the card guide surface 52 is provided with the card guide rails 54, and the card passage gap 56 is formed between the card guide surface 52 and the card guide rails 54. Also, the black light sensors 60 are provided so as to read a card from the card guide surface 52 within the card passage gap 56. Accordingly, the influence of outside light in a card reading part can be reduced, and reading precision can be improved.

Further, in the present embodiment, the computer of the control box 14 functions as a win/lose determining means, the win or lose of a card game is automatically determined on the basis of the numbers of cards that are sequentially read by the black light sensors, and the determined game result is output from the monitor 16 and the win/lose display box 18. Thus, an illegal act can be prevented while the progress of a game can be supported.

Further, in the present embodiment, the computer of the control box 14 functions as an invalid mode setting means, and a first card invalid mode can be set as described above. Accordingly, even when a rule that invalidates the first card is adopted, the card reader 10 can perform game result determination processing adapted to a card game, and can progress a card game smoothly.

Further, in the present embodiment, first and second card detecting sensors (the object detecting sensor 62 and the measurement validity determining sensor 64) are arranged along the guiding direction of the card guide unit 50, and the computer of the control box 14 functions as a measurement validity/invalidity determining means. Accordingly, the computer of the control box 14 can determine whether or not a card has normally passed along the card guide unit 50.

Further, in the present embodiment, the computer of the control box 14 suitably determines that a card normally passed along the card guide unit, when the first card detecting sensor and the second card detecting sensor detect the card in order, and then, the first card detecting sensor and the second card detecting sensor stop detecting a card in order.

Further, in the present embodiment, the computer of the control box 14 invalidates reading of a card, when the card is detected in order of the first card detecting sensor and the second card detecting sensor, and then, detecting a card is stopped in order of the first card detecting sensor and the second card detecting sensor. Accordingly, when a card slips back, it is possible to suitably cope with this.

Further, in the present embodiment, the sensitivity of a second card detecting sensor is set low so as to detect a card for a game and so as not to detect a cut card. Accordingly, when a cut card is used, it is possible to suitably cope with this.

Further, in the card reader 10 of the above-described present embodiment, the black light sensors (UV sensors) detect code elements including a given number from a card which the code elements are arrayed in a card pulling direction as an ultraviolet-ray reaction code, and outputs a detection signal. Also, the card reader 10 includes a number specifying means, and the number specifying means specifies a card associated with the numbers of the code elements on the basis of the detection signals of the black light sensors. In the above embodiment, the code elements are marks printed with ultraviolet-ray reaction ink. Further, the number specifying means is the computer of the control box.

Further, an ultraviolet-ray reaction code may have plural rows of the code elements like the above example. A card may be specified by a combination of the numbers of the plural rows of code elements. In this case, a card is specified from the plural rows of code elements including given numbers. Accordingly, even in this case, the code elements including given numbers are read. Also, the number specifying unit specifies the number of a card associated with the numbers of the code elements.

In the present embodiment, as described above, the numbers of the code elements are associated with at least the number of a card. The numbers of the code elements may be associated with the type (spade, heart, etc.) of a card, in addition to the number of the card. Moreover, the numbers of the code elements may be associated with other information.

According to the present embodiment, since the black light sensors are provided, the code elements are detected by the black light sensors, and a card is specified from the numbers of the code elements, the card can be detected with high precision.

Here, the advantages of the present embodiment will be described in more detail by contrast with a conventional technique.

The conventional technique uses a visible light camera. When the visible light camera is used, an existing conventional picture must be used for a card. The code elements like the present embodiment cannot be used for the following reason. That is, since only a photographic subject of visible light can be read when a camera is used, the code elements should also be printed with visible light ink. However, adding code elements onto a card separately from the conventional existing picture is not allowed in appearance. Accordingly, when the visible light camera is used, the code elements like the present embodiment cannot be used. On the other hand, the black light sensors are used in the present embodiment. Accordingly, the code elements just need to react to ultraviolet rays. That is, the code elements may not ordinarily be a photographic subject of visible light. As such, in the present embodiment, the black light sensors are provided so that the code elements can be utilized as objects to be read other than a conventional picture of a card.

Further, since the visible light camera is conventionally used, the conventional card picture must be used as described above. Therefore, the precision of reading is low, and the threshold value of the card speed at the time of reading is also low. On the other hand, in the present embodiment, the black light sensors detect code elements. Also, a card is specified from the numbers of the code elements. The code elements are, for example, marks. The numbers of the marks just needs to be counted, not the image processing of a picture. Such counting can be performed with high precision. Also, even if the card speed is increased, the counting of the mark numbers can be performed with high precision.

Further, the present embodiment is also different from a bar code reader. In the bar code reader, the thickness of a line is an object to be read. On the other hand, in the present embodiment, the thickness of a line is not detected, but marks are simply detected, and a card is specified from the numbers of the marks. Accordingly, even if the present embodiment is compared with the bar code reader, reading is precise, and the threshold value of the card speed at the time of reading increases.

As such, in the present embodiment, (1) black light sensors are provided, whereby objects to be read become code elements other than the conventional picture, and (2) unlike the conventional image processing of a picture, code elements are detected, and a card is specified from the numbers of the code elements. By virtue of these factors, precision of reading can be improved compared with the conventional technique, and the threshold value of the card speed at the time of reading can also be made high.

As an additional advantage, according to the present embodiment, code elements are suitably given to all the cards. Accordingly, it can be understood that, when any code elements are not detected, a card is abnormal. This is suitably helpful to prevention of an illegal act.

Further, as an additional advantage, according to the present embodiment, the black light sensors can be used to miniaturize an apparatus compared with a configuration provided with the conventional visible light camera.

Further, in the card reader 10 of the present embodiment, the platform 12, the control box 14, the monitor 16, and the win/lose display box 18 are separately provided. As a modified example, some or all of them may be integrated. For example, the control box 14 may be built in the platform 12.

Further, since the card reader 10 of the present embodiment can be used for checking of a card for illegal act prevention, etc., it can be called a card checking apparatus. Also, since the card reader is used along with a shoe (shooter), it can also be called a shoe-type checking apparatus. Also, reading of a code in the above embodiment can also be called measurement for checking. Accordingly, the UV sensors 60 may be called code reading sensors, and may be called measuring sensors.

In another modified example, the card reader 10 of the present embodiment is integrated with a card shooter. In this case, an advantage that an existing card shooter can be utilized is no longer obtained. However, an advantage that reading precision can be improved is obtained, and an advantage that the threshold value of the card speed at the time of reading is raised is obtained.

Figure 14:
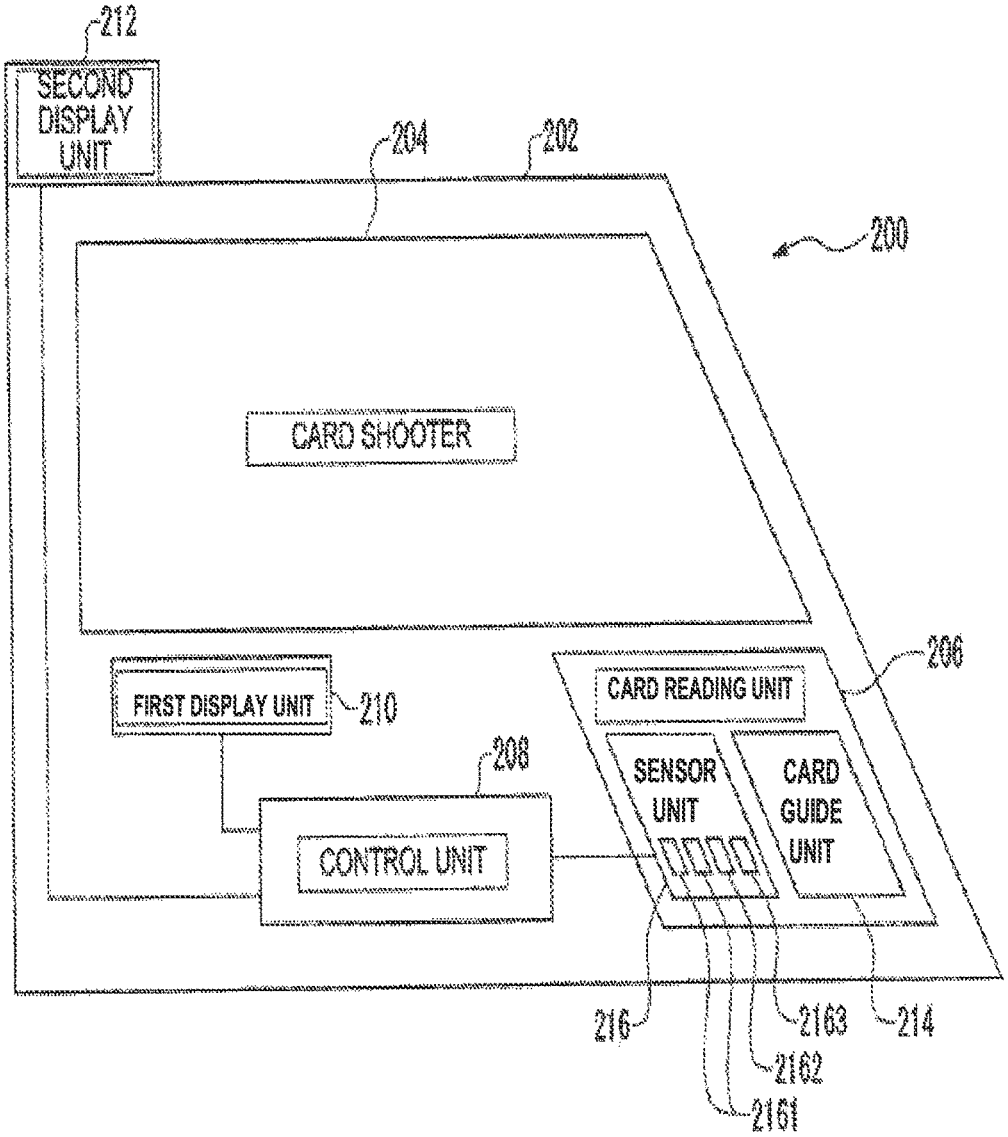
FIG. 14 is a view showing a configuration in which the card reader and the card shooter are integrated.

FIG. 14 shows an integrated configuration. A card shooter apparatus 200 includes a housing 202. The housing 202 corresponds to the configuration in which the housing of the shooter and the housing of the platform in the above-described embodiment are integrated together. The housing 202 is provided with a card shooter unit 204. The card shooter unit 204 includes various components of the above-described card shooter.

The housing 202 is further provided with a card reading unit 206, a control unit 208, a first display unit 210, and a second display unit 212. The card reading unit 206 is composed of a card guide unit 214 and a sensor unit 216.

The card guide unit 214 has the same function as the card guide unit in the above-described embodiment. In the above-described embodiment, the card guide unit is provided in the platform. In this configuration, the card guide unit 214 is provided in the housing 202. The card guide unit 214 may be connected with a card outlet of the card shooter unit 204, and may be integrated with the outlet.

The sensor unit 216 is composed of the sensors of the above-described embodiment. That is, the sensor unit 216 has a black light sensor 2161, an object detecting sensor 2161, a measurement validity determining sensor 2163, and related components. In the above-described embodiment, the sensors are built in the platform. In this configuration, the sensor unit 216 is built in the housing 202. Also, the sensor unit 216 is located in the place where the card guide unit 206 exists.

The control unit 208 is a control device corresponding to the control box of the above-described embodiment. In the above-described embodiment, the control box is arranged separately from the platform. In this configuration, the control unit 208 is built in the housing 202.

The first display unit 210 is the monitor of the above-described embodiment. The second display unit 212 corresponds to the three lamps of the win/lose display box in the above-described embodiment. In the above-described embodiment, the monitor and the lamps are disposed on the table apart from the platform. In this configuration, the monitor of the first display unit 210 is provided on a side surface of the housing 202. Further, the second display unit 212 is provided at a rear end of an upper surface of the housing 202.

Similarly to the above-described embodiment, in the card shooter apparatus 200, a card is read, read data is processed, and a processing result is displayed.

Figure 17:
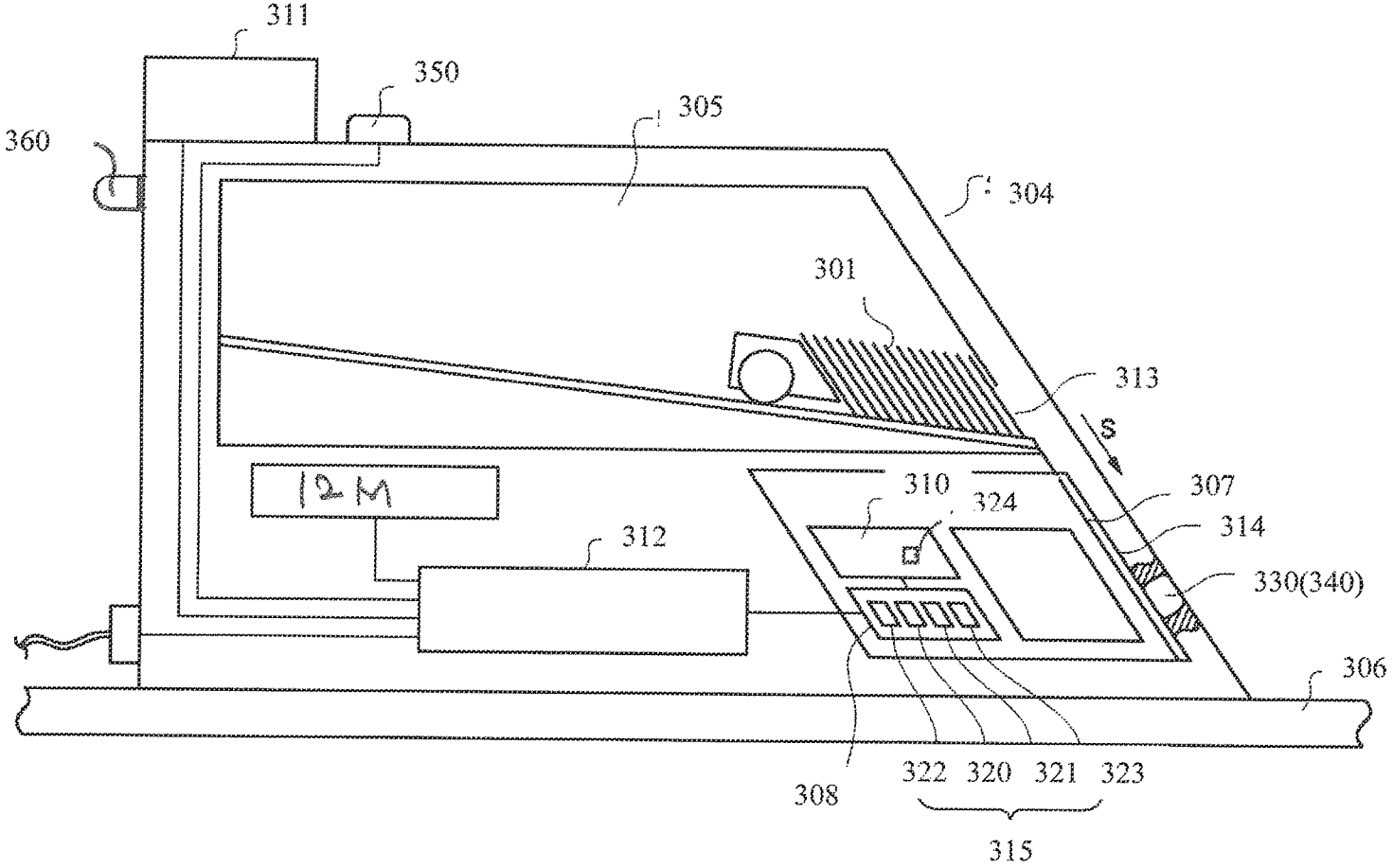
FIG. 17 is a block diagram illustrating the entirety of a card shoe apparatus according to an exemplary embodiment of the present invention.
Figure 18:
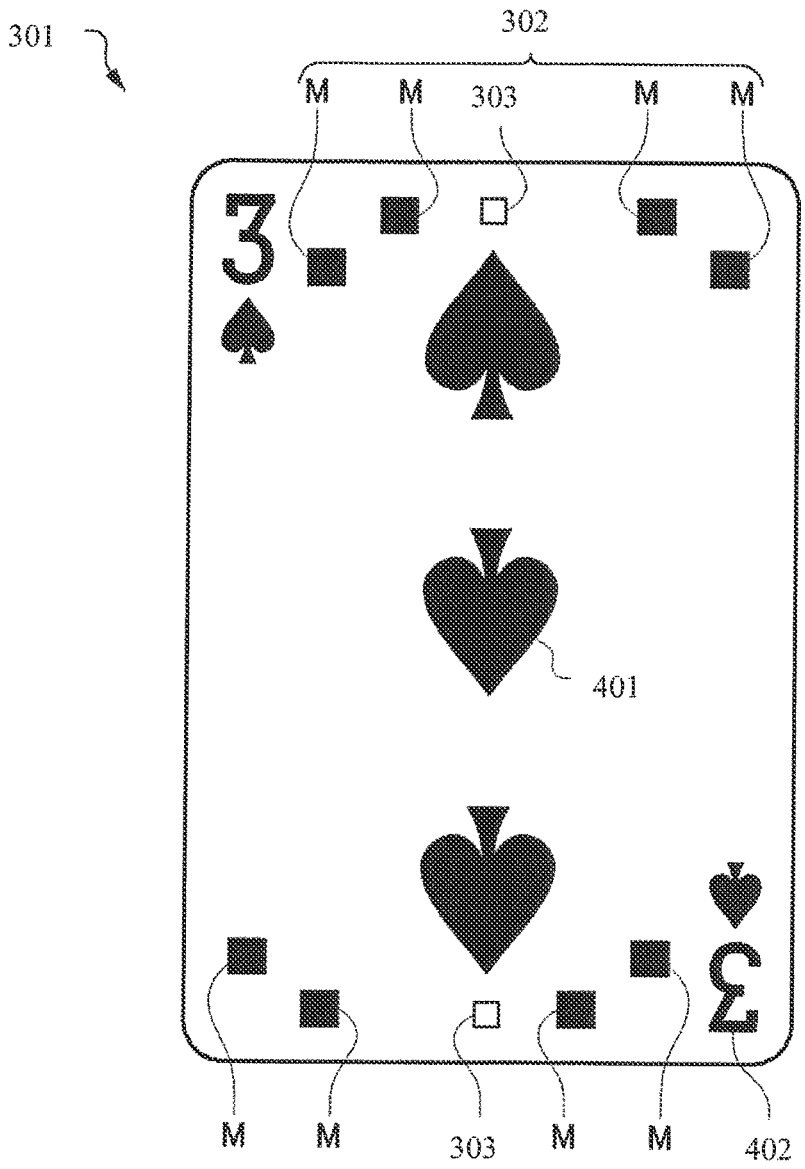
FIG. 18 shows an example of a card according to an exemplary embodiment of the present invention.

An embodiment of a table game system of the present invention will be described below in detail. FIG. 17 is a block diagram illustrating a card shoe apparatus, generally designated by reference number 304, for use in a table game system according to an exemplary embodiment of the present invention. FIG. 18 illustrates a card 301 that may be used in the table game system according to an exemplary embodiment of the present embodiment. The card 301 may be used in a table game such as baccarat. A code 302 may be disposed at the upper side and the lower side of the face of the card 301 in a point-symmetric manner. The code 302 may be composed of marks M that are invisible to the naked eye. Also, the card 301 includes an authenticity determination code 303 made up of coded information that indicates the authenticity of the card. The authenticity determination code 303 is arranged by printing or the like so as to be invisible to the naked eye, using, for example, ultraviolet reactive ink.

The card shoe apparatus 304 includes a card guide unit 307 that guides cards 301 that are manually drawn out one by one from a card housing unit 305 onto a game table 306, a code reading unit 308 that reads, when a card 301 is manually drawn out from the card housing unit 305 by a dealer or the like of a casino, the code 302 that indicates a figure (number, rank) of that card 301, a winning/losing determination unit 310 that determines the winning/losing of the card game based on the numbers of the cards 301 sequentially read by the code reading unit 308, and an output means 311 that outputs the result of the determination made by the winning/losing determination unit 310. The card guide unit 307 includes a card movement restriction means 330, 340 (to be described later) that restricts the movement of the card 301 from the card housing unit 305.

Figure 19:
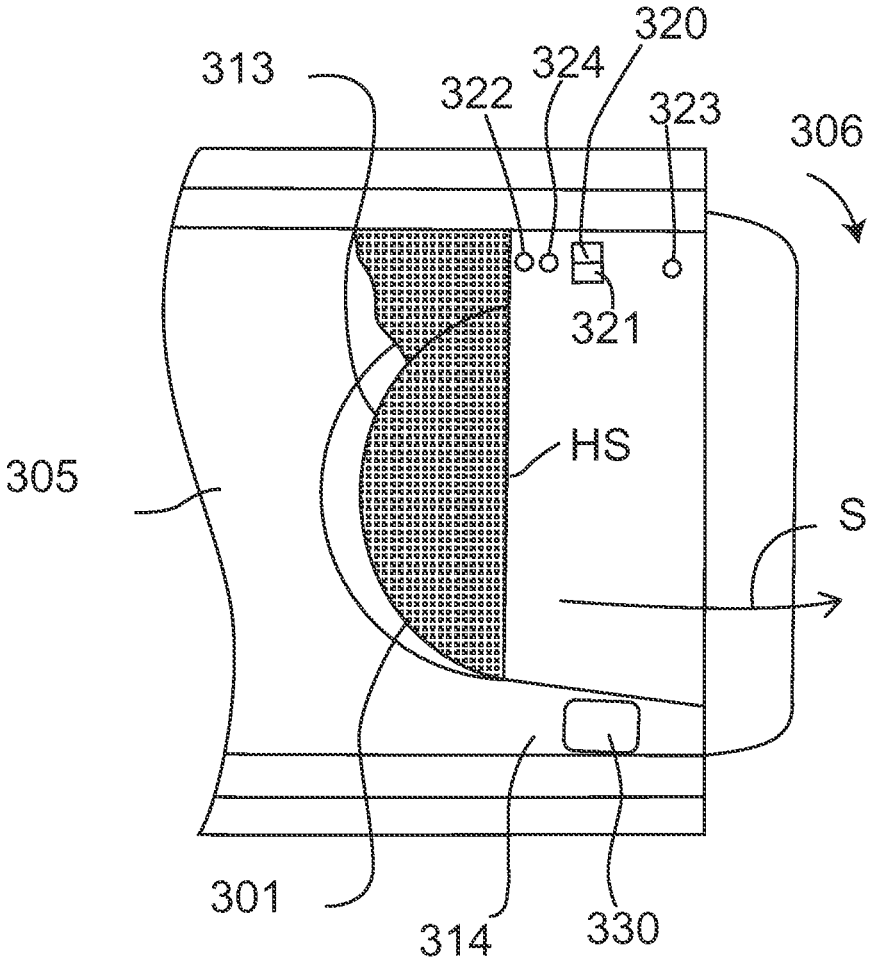
FIG. 19 is a plan view of a main portion of a card guide of the card shoe apparatus, with the card guide partially broken, according to an exemplary embodiment of the present invention.

Next, the code reading unit 308 that reads, from a card 301, the code 302 that indicates a figure (number, rank) of the card 301 when the card 301 is manually drawn out from the card housing unit 305 will be described in detail with reference to FIG. 19. The code reading unit 308 is provided in the card guide unit 307 that guides the cards 301 manually taken out one by one from an opening 313 onto the game table 306, with the opening 313 provided in a front portion of the card housing unit 305. The card guide unit 307 includes an inclined surface and a card guide 314 attached at an edge portion of each of both sides of the inclined surface, with the card guide 314 also serving as a sensor cover. The card guide 314 is configured to be attachable/detachable with screws or the like (not shown) so as to be replaceable. When a card guide 314 is removed, a sensor group 315 of the code reading portion 308 is exposed. The sensor group 315 is composed of four sensors, including two ultraviolet reactive sensors (UV sensors) 320 and 321, and object detection sensors 322 and 323.

The object detection sensors 322 and 323 are optical fiber sensors that each detect the presence of the card 301, and are capable of detecting movement of the card 301. The object detection sensor 322 is placed in the upstream side of the card guide unit 307 with respect to the travel direction of the card 301 (indicated by the arrow S in FIG. 19), and the object detection sensor 323 is placed in the downstream side of the card guide unit 307 with respect to the travel direction of the card 301. As shown in FIG. 19, the object detection sensors 322 and 323 are respectively provided in the upstream side and the downstream side of the UV sensors 320 and 321. The UV sensors 320 and 321 each include an LED (UV LED) that emits an ultraviolet ray and a detector. The marks M are printed on the card 301 in UV luminescent ink that emits color when UV ray is applied. The card 301 is irradiated with the UV ray (black light), and the detector detects the light reflected by the marks M of the code 302 of the card 301. The UV sensors 320 and 321 are connected to a control apparatus 312 of the code reading unit 308 via a cable. In the code reading unit 308, the arrangement patterns of the marks M are determined based on the output signals from the detectors of the UV sensors 320 and 321, such that the number (rank) corresponding to the code 302 is determined.

In the code reading unit 308, the start and end of the reading performed by the UV sensors 320 and 321 are controlled by the control apparatus 312 based on the detection signals from the object detection sensors 322 and 323. Also, the control apparatus 312 determines whether the card 301 has normally passed through the card guide unit 307 based on the detection signals from the object detection sensors 322 and 323. As shown in FIG. 18, the rectangular marks M are arranged within a framework of two rows with four columns on each of the upper and bottom edges of a card, and the arrangement of such marks indicates the rank (number) and the suit (Heart, Spade or the like) of the card. According to an exemplary embodiment, for each card, a mark M may either be present or absent at each of the predetermined locations within the framework of rows and columns depending on the particular mark and suit to be encoded. When the UV sensor(s) 320 and/or 321 detect(s) a mark M that is filled in, such UV sensor(s) output(s) an on signal, and when the UV sensor(s) 320 and/or 321 do not detect a mark M, an on signal is not generated. In this way, the code reading unit 308 identifies the code based on the relative difference or the like between the two marks M detected by the two UV sensors 320 and 321, thereby identifying the number (rank) and the type (suit) of the corresponding card 301.

The relation between the code 302 and the output of the on signals from the two UV sensors 320 and 321 are shown in FIG. 5. It is possible to identify a predetermined arrangement pattern of the marks M based on the comparison results of the relative changes in the output of the on signals from the UV sensors 320 and 321. As a result, in two rows (the upper and lower rows), four types of arrangement patterns of the mark M are possible, and since patterns are printed in four columns, it is possible to form 256 types of codes (4.times.4.times.4.times.4). Fifty two (52) playing cards are each assigned to one of the 256 codes, and the relations of such assignment are stored in memory 12M as an association table. A configuration is thereby adopted in which the card reading unit 308 can, by identifying the code 302, identify the number (rank) and the type (suit) of the card 301 based on that predetermined association table (not shown). It should be appreciated that the assignment of a specific code of the 256 codes to each playing card does not need to be fixed, and in other exemplary embodiments of the invention each of the 52 cards can be freely associated with 52 codes out of the 256 codes to be stored in the association table, and thus a variety of associations are possible. Therefore, it is possible to change the associations between the 256 codes and 52 cards depending on the time or place. Preferably, the code is printed with a paint material that becomes visible when irradiated with UV ray, and placed in a position where it does not overlap the indications of the card types or indexes 402.

An association table may be prepared by freely associating 52 codes out of the 256 codes with 52 cards, and a plurality of different association tables (ex. 1 to 10 or more tables) may be prepared in advance. If the code 302 does not match the code defined in the applicable association table, an error is detected and it is determined that cheating may have occurred.

Next, the configuration of the control apparatus 312 will be described. The control apparatus 312, the code reading unit 308, the winning/losing determination unit 310 and the like are realized by a computer apparatus, and in particular a computer apparatus including at least a memory, at least a processor, and at least a non-transitory computer readable medium on which may be stored instructions that are read by the at least one processor to perform algorithms according to various exemplary embodiments of the present invention. The numbers of cards sequentially taken out onto the game table 306 are acquired using the UV sensors 320 and 321 in the code reading unit 308, and the numbers of cards thus acquired are sequentially stored in a memory. At this time, information on which card 301 is dealt to which player is also stored. The number of each card is stored in association with the player to whom that card was dealt. In baccarat, there is a player and a banker. The rank (number) of the card dealt is stored in the memory in association with the player to whom it was dealt, and the ranks (number) of the cards dealt are added for each player, and the winner is determined based on the programmed rules. A "tie" is also judged. The winning/losing determination unit 310 determines the winning/losing of the card game based on the numbers of the cards 301 sequentially read by the code reading unit 308 and whether the game of this round is over. When the game of this round is over, an operator or dealer is required to push a result key 360 on the side of a card shoe apparatus 304 to let the output means 311 output the result of the game.

Figure 20A:
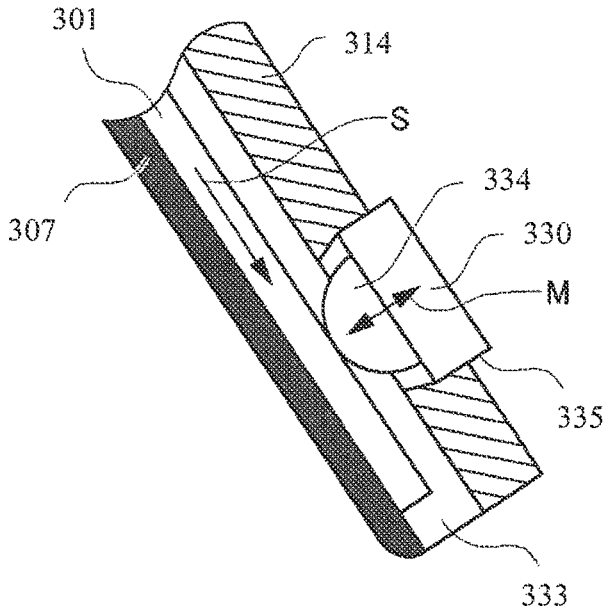
FIG. 20(*a*) is a cross-sectional view illustrating a main portion of a card movement restriction means according to an exemplary embodiment of the present invention that restricts the movement of cards from a card housing unit of the card shoe apparatus of FIG. 17 as viewed from the side.
Figure 20B:
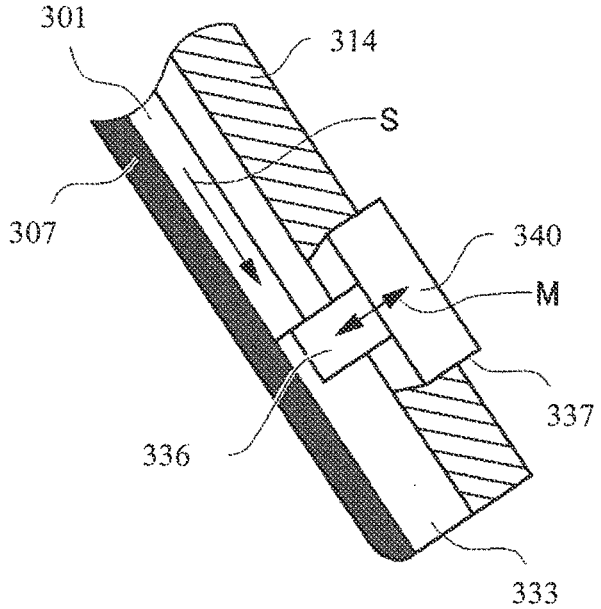
Figure 22:
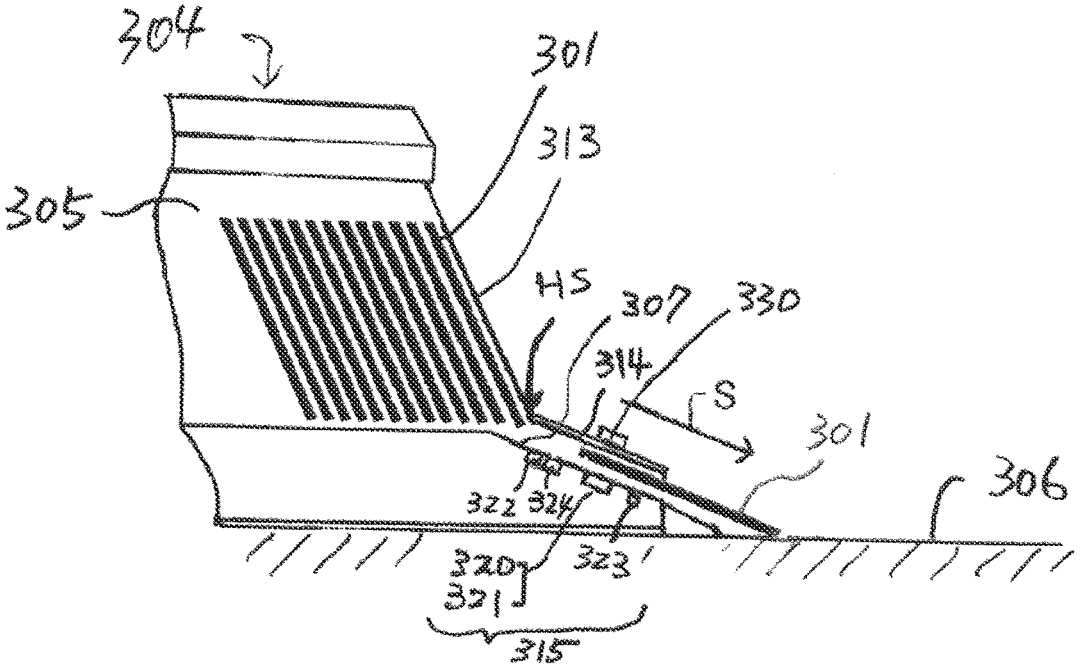
FIG. 22 is a block diagram illustrating a card shoe apparatus according to an exemplary embodiment of the present invention.

Next, the card movement restriction means 330 that restricts the movement of the card 301 to/from the card housing unit 305 will be described with reference to FIGS. 20(*a*), 20(*b*) and 22. In FIG. 20(*a*), the card movement restriction means 330 is provided in the card guide 314 of the card guide unit 307 that guides the cards 301 taken out one by one from the opening 313, which is provided in a front portion of the card housing unit 305. The card movement restriction means 330 has a structure by which when a card 301 passes through a slot 333 between the card guide unit 307 and the card guide 314, a lock member 334 presses the card 301 to prohibit the movement of the card 301 within the slot 333. The lock member 334 is capable of moving in the direction indicated by the arrow M by a driving unit 335 composed of an electromagnetic solenoid, a piezoelectric device or the like, such that it can take two positions, namely, a position where the card 301 is pressed (restricted position) and a position where the card 301 is allowed to pass through. The driving unit 335 is controlled by the control apparatus 312, and causes the lock member 334 to move to two positions, namely, a position where the card 301 is pressed and a position where the card 301 is allowed to pass through. The rules of the baccarat game are programmed and stored in advance in the control apparatus 312.

Next, an alternative embodiment of the card movement restriction means 330 will be described with reference to FIG. 20(*b*). According to this embodiment, a card movement restriction means 340 has a structure by which when a card 301 passes through the slot 333 between the card guide unit 307 and the card guide 314, a lock member 336 protrudes into the slot 333 to prohibit movement of the card 301. The lock member 336 is capable of moving in the direction indicated by the arrow M by a driving unit 337 composed of an electromagnetic solenoid, a piezoelectric device or the like, such that it can take two positions, namely, a position where movement of the card 301 is prohibited (restricted position) and a position where the card 301 is allowed to pass through. The driving unit 337 is controlled by the control apparatus 312, and causes the lock member 336 to move to two positions, namely, a position where movement of the card 301 is prohibited and a position where the card 301 is allowed to pass through.

The card movement restriction means 330 (340) is caused to function as a result of the driving unit 335 or 337 being controlled by the control apparatus 312 to prevent the fraudulent movement of the card 301. The card movement restriction means 330 (340) is provided with the object detection sensors 322 and 323 as sensors for detecting movement of the card 301, and has a function of detecting movement of the card 301 with these sensors 322 and 323 to restrict the erroneous or fraudulent movement of a card. In this regard, the card movement restriction means 330 (340) may be controlled to prevent the movement of the card 301 in at least the following situations:

1) when there is an attempt to draw a card at an inappropriate time. For example, the drawing of a card 301 from the card housing unit 305 may be prohibited when such drawing should not be allowed based on the information from the winning/losing determination unit 310. The winning/losing determination unit 310 determines the winning/losing of the card game based on the numbers of the cards 301 sequentially read by the code reading unit 308 and whether the game of the particular round is over. When the round is over, the dealer must push a result key 360 on the side of a card shoe apparatus 304 to instruct the output means 311 to output the result of the game. However, the dealer may attempt to withdraw a card after the round is over and before pushing the result key 360, in which case an overdraw error may be detected and the attempted withdrawal of the card may be prohibited by the card movement restriction means 330(340). In particular, when the object detection sensors 322 detects a card (FIG. 19), the card movement restriction means 330 (340) may be controlled to prohibit the drawing of a card 301 from the card housing unit 305 when such drawing should not be allowed. Since there is some distance between the position of the object detection sensors 322 and the position of the card movement restriction means 330 (340), there is enough time between when the object detection sensors 322 detects erroneous movement of a card and when the driving unit 335 or 337 begins operation to restrict the card from drawing further.

2) when the card stands still (stops) at predetermined period of time at the opening of the card housing unit. For example, when the object detection sensors 322 detects a card is being held in the card guide unit 307 for longer than a predetermined time, an error signal may be generated and, based on the error signal, the card movement restriction means 330(340) may prohibit further movement of the card. In this regard, a timer (not shown) may be activated when the object detection sensors 322 detect the card, and once the timer reaches a predetermined count, the card movement restriction means 330(340) may be controlled to prohibit further card movement.

3) when a card 301 is inserted from the exterior toward the card housing unit via the opening unit in a reverse direction, opposite to the direction of the arrow S, namely, from the exterior toward the card housing unit 305 via the opening 313. In this case, although the card 301 inserted for the purpose of cheating passes through the slot 333 between the card guide unit 307 and the card guide 314, the movement of the card 301 in a direction opposite to the normal direction (the direction opposite to the arrow S in FIG. 19) is detected based on the detection signals from the object detection sensors 322 and 323. The driving units 335 or 337 may then move their corresponding lock members 334 or 336 to their respective positions of pressing or blocking the card 301, respectively.

4) when a card is misread. For example, the card movement restriction means 330(340) may be controlled to prohibit movement of a card when the code reading unit 308 is unable to identify a code 302 on the card, such as when a code is not present on the card or when the code is present but does not correspond to any code within a code association table. A misreading error may also occur when it is detected that the card has not normally passed along the card guide unit 307 or has slipped back.

5) when an authenticity determination code detected by authenticity determination code sensor placed in the card guide unit 307 does not match the predetermined proper authenticity determination code. In this regard, a card 301 may be provided with an authenticity determination code 303 that is configured by encoding information that represents the group of the card. For example, card sets may be assigned a group code depending on the particular casino, casino group, casino location, geographical areas or countries in which the cards are intended for use. The authenticity determination code may be printed using, for example, UV ink, so as to be invisible to the naked eye, and is provided in the same position in at least the cards of the same set (i.e., all cards to be used at the same casino). The authenticity determination code 303 is made of a substance or material itself that emits, as a code, light rays of different wavelength spectra when irradiated with light rays. An authenticity determination code corresponding to a particular set of cards used in a card game may be stored in the memory unit and referred to by the control unit 312. Accordingly, the authenticity determination code 303 on a card can be read by the code reading unit 308 (sensor 324) and compared to the stored authenticity determination code. If there is a mismatch between the stored code and the code on the card, the card movement restriction means 330(340) may be activated to prohibit further movement of the card.

5) when an authenticity determination code detected by authenticity determination code sensor placed in the card guide unit 307 does not match the predetermined proper authenticity determination code. In this regard, a card 301 may be provided with an authenticity determination code 303 that is configured by encoding information that represents the group of the card. The authenticity determination code may be printed using, for example, UV ink, so as to be invisible to the naked eye, and is provided in the same position in at least the cards of the same set. The authenticity determination code 303 is made of a substance or material itself that emits, as a code, light rays of different wavelength spectra when irradiated with light rays. An authenticity determination code corresponding to a particular set of cards used in a card game may be stored in the memory unit and referred to by the control unit 312. Accordingly, the authenticity determination code 303 on a card can be read by the code reading unit 308 (sensor 324) and compared to the stored authenticity determination code. If there is a mismatch between the stored code and the code on the card, the card movement restriction means 330(340) may be activated to prohibit further movement of the card.

The drawing of a card 301 from the card housing unit 305 may be prohibited when (1) the code 302 read by the code reading unit 308 does not match the code defined in the association table and (2) the authenticity determination code 303 detected by the authenticity determination code sensor 324 placed in the upstream side of the card guide unit 307 does not match the predetermined proper authenticity determination code. The presence of at least one of these conditions may be indicative of cheating, and an error signal may be generated so that the card movement restriction means 330 (340) is operated to prevent further movement of a card.

Upon operation of the card movement restriction means 330(340), an error signal output means 350 disposed on the card housing unit 305 may provide an external signal indicating that an error has occurred. The error signal output means 350 may include, for example, a lamp and/or an audible alarm.

Figure 23A:
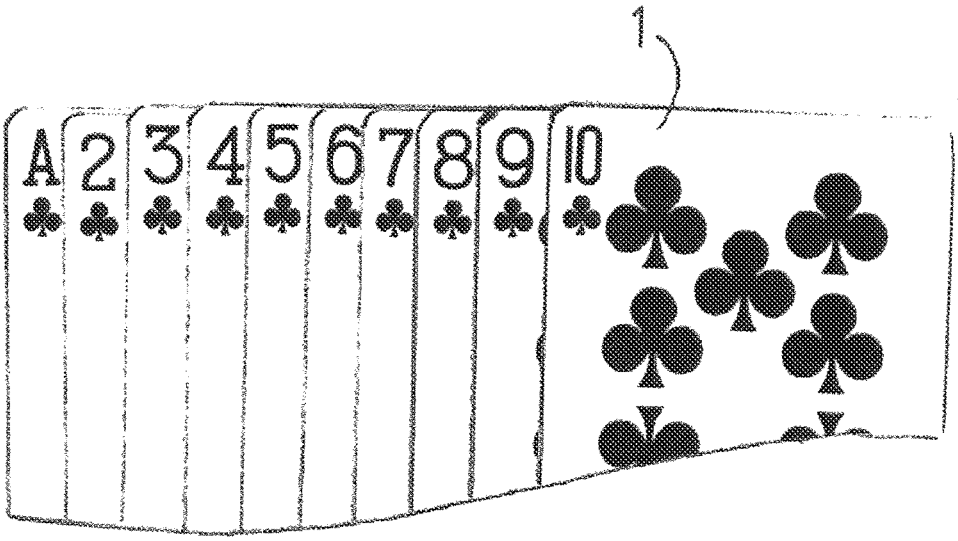
FIGS. 23(*a*) and 23(*b*) show cards that have been improperly shuffled according to exemplary embodiments of the present invention.
Figure 23B:
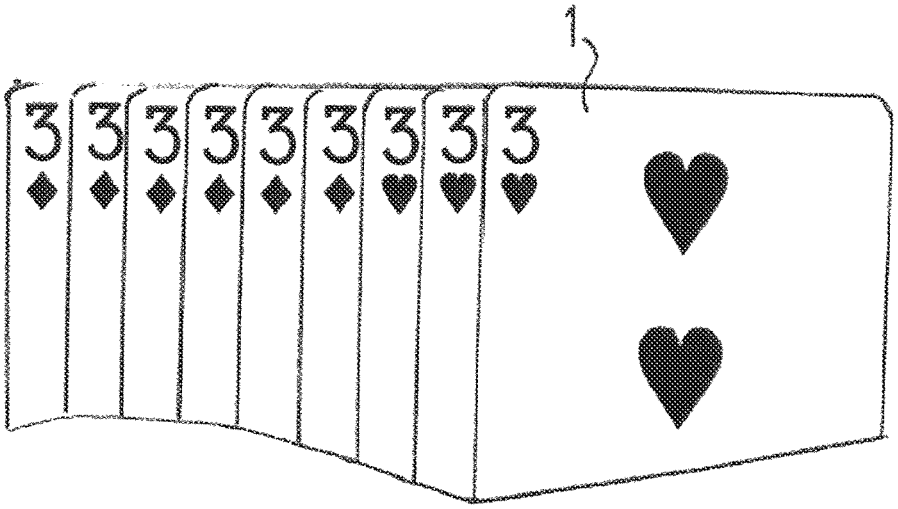

According to an exemplary embodiment of the present invention, the card shoe apparatus 304 may detect an irregularity in the manner in which the cards are shuffled and in some cases generate an alert and/or prohibit removal of cards from the card housing unit 305 based on the detected irregularity. In this regard, the information collected by the card reading unit 308 as the cards are drawn from the card housing unit 305 may be used to determine whether the cards have been shuffled improperly. An irregularity in the arrangement order of the cards will be described with reference to FIG. 23(*a*) and FIG. 23(*b*). FIG. 23(*a*) shows an example where the cards 301 drawn from the card housing unit 305 have the same suit (Clubs) with sequential figures (number, rank) beginning from Ace. FIG. 23(*b*) shows an example where the cards 301 drawn from the card housing unit 305 consist of 9 cards with the same rank (3). Generally, the cards 301 are shuffled by a random number generator or the like so as to be arranged in a random order. The arrangement of the cards 301 shown in FIGS. 23(*a*) and 23(*b*) is substantially non-random, thus indicating an irregular shuffling of the playing cards 301. Other examples of card arrangements which may indicate a shuffling irregularity include:

(a) a case in which a predetermined number of cards within a set of cards exhibit a pattern in which the rank of a card is larger (or smaller) by one as compared to compared to the rank of the preceding card (for example, 1, 2, 3, 4, - - - , K) (as shown in FIG. 23(*a*));

(b) a case where a predetermined number of cards in sequence have the same rank (for example, A, A, A, A, - - - ) (as shown in FIG. 23(*b*));

(c) a case where the same sequence is repeated throughout a predetermined number of cards (for example, A, Q, 10, A, Q, 10, - - - );

(d) a case where a predetermined number of cards in sequence have the same suit (for example, 13 consecutive cards with Hearts);

(e) a case in which a predetermined number of cards in each of two or more sets of cards have the same sequence of suit and rank (A,5,Q,J,2,8,9,K, - - - ). In particular, for each card game, a different set of cards may be housed in the card shoe apparatus 304. A shuffling irregularity may be detected if a predetermined number of cards in a later-used set match the same predetermined number of cards in an earlier-used set in terms of suit and/or rank sequence; and (f) a case where the order of a predetermined number of cards matches an order registered in advance (for example, where the order of the cards matches the order of cards used in a separate card manufacturing process).

Irregular shuffling patterns (such as examples (a)-(d)) as well as the sequence of suit and rank (e.g., A,5,Q,J,2,8,9, K, - - - ) of card sets previously housed in the card shoe apparatus 304 may be stored in the memory 312M, and the control unit 312 may use this stored information to determine whether irregular shuffling has occurred. For example, irregular shuffling may be determined if the order of a predetermined number of cards 301 within a set matches at least a portion of the stored patterns. In another example, irregular shuffling may be determined if a number of card sets each used in one of a predetermined number of games include a predetermined number of cards that match the stored patterns.

As another example, a shuffling irregularity may be determined when each deck of cards within a set of cards is detected to be shuffled in the same or substantially similar way. For example, a shuffling irregularity may be detected when, for a plurality of cards, the suit and rank of each card drawn are the same as those of the card preceding it by 52 cards. In such a case, shuffling of a plurality of decks has failed for some reason, and instead each of the 52 cards is arranged in the same order.

In general, a shuffling irregularity may be detected when a stored pattern continues throughout a predetermined number of cards. In this regard, a preliminary alarm of irregularity may be generated at some point prior to the stored pattern being detected in all of the predetermined number of cards. For example, a preliminary alarm may be generated upon the drawing of a card that is several cards before the end of a predetermined number of cards. The preliminary alarm may be in a form different from the final alarm, for example, by characters, in a certain color, or with a different lamp. In an exemplary embodiment, if a state does not continue to be irregular throughout a predetermined number of cards and returns to a random state, then the preliminary alarm may be cancelled.

If a shuffling irregularity is detected, a final alarm may be generated and the control unit 312 may operate the card movement restriction means 330(340) to restrict movement of the card 301 relative to the opening 313 in the card housing unit 305.

The preferred embodiment of the invention has been described hitherto. However, it is natural that the invention is not limited to the above-described embodiment, but persons skilled in the art can alter the above-described embodiment within the scope of the invention.

The invention claimed is:

1. A method comprising:

reading, during a round of a card game and using one or more processors, numbers of cards as the cards are sequentially taken out from a card housing and delivered to a player or a banker, a card shooter including the card housing having an opening from which the cards are manually withdrawn from the card housing one by one during the card game;

detecting that one of the cards is located at the opening for longer than a predefined period of time;

outputting a first signal of a result of the detection, wherein the output of the first signal causes a prevention of further delivery of the cards;

determining, using at least one card detecting sensor located on one or more card guide rails, whether there is an attempt to draw a card after the round is over, wherein the attempt to draw the card after the round is over is determined according to the reading of the numbers of the cards as the cards are sequentially taken out from the card shooter and delivered to the player or the banker; and based on a condition that the attempt to draw the card after the round is over is determined, generating a second signal indicating the attempt to draw the card after the round is over;

wherein:

the at least one card detecting sensor is configured to detect a direction in which any of the cards passes by the at least one card detecting sensor, the second signal being generated based on the detected direction;

the at least one card detecting sensor is arranged below or behind an exterior surface of the card shooter and is configured to detect the cards when the cards are positioned on top or in front of the exterior surface;

the at least one card detecting sensor includes a first object detection sensor and a second object detection sensor that is, with respect to a direction in which the cards are withdrawn from the card shooter, downstream of the first object detection sensor, and the method further comprises using a combination of signals of the first and second object detection sensors to identify a flow of a card relative to the card shooter; and/or the at least one card detecting sensor includes two optical sensors arranged on opposite sides of a center of a path through which the cards are withdrawn from the card shooter.

2. The method of claim 1, further comprising storing results of the reading.

3. The method of claim 1, further comprising tracking progress of the card game based on the numbers of the cards delivered to the player or the banker and based on rules of the card game.

4. The method of claim 1, further comprising activating, using one or more processors, a card lock based on the first or second signal to restrict further movement of the cards so as to prevent automatic reading of numbers of the cards.

5. The method of claim 1, further comprising, based on the first or second signal, preventing reading of numbers of the cards.

6. The method of claim 1, wherein the at least one card detecting sensor includes a first card detecting optical sensor.

7. The method of claim 6, wherein the at least one card detecting sensor includes a second card detecting optical sensor.

8. The method of claim 1, further comprising determining a result of a round of the card game.

9. The method of claim 1, further comprising determining a result of the card game.

10. The method of claim 1, wherein the at least one card detecting sensor is configured to detect a direction of any of the cards, the first or second signal being generated based on the detected direction.

11. The method of claim 1, wherein the at least one card detecting sensor is arranged below or behind an exterior surface of the card shooter and is configured to detect the cards when the cards are positioned on top or in front of the exterior surface.

12. The method of claim 1, wherein the at least one card detecting sensor includes a first object detection sensor and a second object detection sensor that is, with respect to a direction in which the cards are withdrawn from the card shooter, downstream of the first object detection sensor, and the method further comprises using a combination of signals of the first and second object detection sensors to identify a flow of a card relative to the card shooter.

13. The method of claim 12, wherein the at least one card detecting senor further includes an optical sensor arranged between the first and second object detection sensors.

14. The method of claim 13, wherein the reading of the numbers is performed by the optical sensor.

15. The method of claim 1, wherein the at least one card detecting sensor includes two optical sensors arranged on opposite sides of a center of a path through which the cards are withdrawn from the card shooter.

16. The method of claim 1, further comprising performing a sensing operation using at least one card detecting sensor located on one or more card guide rails, wherein the detecting is performed based on the reading and the sensing operation.

17. The method of claim 1, wherein:

the at least one card detecting sensor is configured to detect the direction in which any of the cards passes by the at least one card detecting sensor, the second signal being generated based on the detected direction;

the at least one card detecting sensor is arranged below or behind the exterior surface of the card shooter and is configured to detect the cards when the cards are positioned on top or in front of the exterior surface;

the at least one card detecting senor includes the first object detection sensor and the second object detection sensor that is, with respect to the direction in which the cards are withdrawn from the card shooter, downstream of the first object detection sensor, and the method further comprises using the combination of signals of the first and second object detection sensors to identify the flow of the card relative to the card shooter; and the at least one card detecting sensor includes the two optical sensors arranged on opposite sides of the center of the path through which the cards are withdrawn from the card shooter.

* * * * *